US010999909B2

(12) United States Patent
Sudhaus et al.

(10) Patent No.: US 10,999,909 B2
(45) Date of Patent: May 4, 2021

(54) LED LIGHTING DEVICE, PARTICULARLY FOR VEHICLES

(71) Applicant: Elmos Semiconductor SE, Dortmund (DE)

(72) Inventors: Andre Sudhaus, Dortmund (DE); Niyant Patel, Novi, MI (US)

(73) Assignee: ELMOS SEMICONDUCTOR SE, Dortmund (DE)

( * ) Notice: Subject to any disclaimer, the term of this patent is extended or adjusted under 35 U.S.C. 154(b) by 168 days.

(21) Appl. No.: 16/340,746

(22) PCT Filed: Oct. 12, 2017

(86) PCT No.: PCT/EP2017/076106
§ 371 (c)(1),
(2) Date: Apr. 10, 2019

(87) PCT Pub. No.: WO2018/069464
PCT Pub. Date: Apr. 19, 2018

(65) Prior Publication Data

US 2021/0014949 A1 Jan. 14, 2021

(30) Foreign Application Priority Data

Oct. 13, 2016 (DE) ..... 10 2016 119 584.7
Mar. 7, 2017 (WO) ..... PCT/EP2017/055286
(Continued)

(51) Int. Cl.
*H05B 45/46* (2020.01)
*H05B 45/50* (2020.01)
(Continued)

(52) U.S. Cl.
CPC ..... *H05B 45/3725* (2020.01); *H05B 45/46* (2020.01); *H05B 45/50* (2020.01)

(58) Field of Classification Search
None
See application file for complete search history.

(56) References Cited

U.S. PATENT DOCUMENTS

2008/0204029 A1 8/2008 Mihai et al.

FOREIGN PATENT DOCUMENTS

AT 5 190 U1 4/2002
AT 5190 * 4/2002
(Continued)

OTHER PUBLICATIONS

International Search Report and Written Opinion for PCT/EP2017/076106 dated Nov. 22, 2017 (10 pages; with English translation).

*Primary Examiner* — Dedei K Hammond
(74) *Attorney, Agent, or Firm* — Mindful IP PLLC

(57) ABSTRACT

A device for supplying at least two LED chains with electricity detects and then signals an interruption in the current path through the LED chains. A sub-device, in the event of a short circuit of an LED within a first LED chain, brings about a detection and/or a subsequent signalling of an interruption of the current path within another LED chain of these at least two LED chains. The associated method comprises the steps of detecting the short circuit of an individual LED in a first LED chain and of interrupting, as a result, the flow of current through at least one other LED chain and subsequently detecting this interruption of the flow of current through the other LED chain by means of the interruption detection system already existing as required.

10 Claims, 9 Drawing Sheets

(30) Foreign Application Priority Data

Oct. 6, 2017 (DE) ..... 10 2017 123 259.1
Oct. 6, 2017 (DE) ..... 10 2017 123 260.5

(51) Int. Cl.
*H05B 45/37* (2020.01)
*H05B 45/3725* (2020.01)

(56) References Cited

FOREIGN PATENT DOCUMENTS

| | | | | |
|---|---|---|---|---|
| DE | 10 2006 058 509 | A1 | | 6/2007 |
| DE | 10 2007 001 501 | A1 | | 7/2007 |
| DE | 10 2009 028101 | A1 | | 2/2010 |
| DE | 10 2008 047 731 | A1 | | 3/2010 |
| DE | 10 2008 037551 | A1 | | 5/2010 |
| DE | 102008037551 | | * | 5/2010 |
| DE | 10 2014 112 171 | A1 | | 2/2015 |
| WO | 2012077013 | A2 | | 6/2012 |

* cited by examiner

LED LIGHTING DEVICE, PARTICULARLY FOR VEHICLES

CROSS-REFERENCE TO RELATED APPLICATIONS

This application is a national stage of, and claims priority to, Patent Cooperation Treaty Application No. PCT/EP2017/076106, filed on Oct. 12, 2017, which application claims priority to German Application No. DE 10 2016 119 584.7, filed on Oct. 13, 2016, Patent Cooperation Treaty Application No. PCT/EP2017/055286, filed on Mar. 7, 2017, German Application No. DE 10 2017 123 259.1 filed on Oct. 6, 2017, and German Application No. DE 10 2017 123 260.5, filed on Oct. 6, 2017, which applications are hereby incorporated herein by reference in their entireties.

The disclosure relates to an LED lighting device, particularly for vehicles. In particular the disclosure relates to devices and methods for supplying LED chains with electricity, with the possibility of detecting short circuits of individual LEDs.

LED lighting devices for vehicles have formed part of the prior art for a number of years. LED lighting means are preferred over filament lighting means due to their service life and their lack of susceptibility to malfunctions.

In LED lighting devices for vehicles, what are known as LED chains are sometimes used, which are formed of series connections of multiple LEDs. What are known as multi-channel power supply units in the form of ICs are known as drivers of LED lighting devices of this kind and for each channel have a failure monitoring system in the form of, for example, a current or voltage detector. Whereas an interruption in current through the LED chain or a total short circuit of the LED chain can be quite easily identified by the detector, the detection of short circuits of individual LEDs causes problems. This is due to the fact that unfortunately the voltage drop across an LED chain in normal operation is not constant and in particular is dependent on the age of the LEDs, temperature thereof, etc. A voltage drop that changes slightly, as occurs for example in the event of a short-circuit of an individual LED, therefore cannot be detected unequivocally as a short circuit.

Devices for operating LED chains, that is to say LED series circuits, are known from DE-A-10 2008 037 551, DE-A-10 2009 028 101, AT-U-005 190, US-A-2008/0204029 and WO-A-2012/077013.

The disclosure relates to a device for supplying at least two LED chains $L_1$,$L_2$,$L_3$ with electricity, in which the failure of individual LEDs within the LED chains as a result of an LED short circuit, referred to hereinafter by the reference sign SC, constitutes a fault that is to be detected. Integrated circuits used for supplying electricity to LED chains of this kind typically are able to identify and then signal an interruption in the current path within one of these LED chains $L_1$,$L_2$,$L_3$. However, the identification of short circuits of individual LEDs is not possible in the prior art.

Document DE-A-10 2014 112 171 discloses a method for identifying a short-circuit in a first light-emitting diode element, in which the first light-emitting diode element within the scope of a specific measurement is operated in a reverse-bias region, a check is performed to ascertain whether an electrical current flows across the first light-emitting diode element in the reverse direction, and a short circuit is identified if the check reveals that the current flows in the reverse direction and is greater than a predefined leakage current. A methodology of this kind is unsuitable for short-circuit identification in an LED chain.

DE-A-10 2008 047 731 discloses a method for detecting faults in a lighting device having a plurality of light-emitting diodes connected in series, wherein the fault detection is achieved by determining the voltage drop of individual series-connected light-emitting diodes or by determining the voltage drop of groups of a plurality of the series-connected light-emitting diodes and by evaluating this voltage drop or these voltage drops. A particular feature is that the evaluation is performed by a comparison with a reference value that changes over time. Here, it is disadvantageous that a separate voltage-determining device is required for the voltage drop, which increases the outlay for the identification of short circuits of individual LEDs.

DE-A-10 2007 001 501 discloses a device which by means of an analogue-to-digital converter in a microcontroller monitors the individual voltage drops across the LEDs of an LED chain during operation. It is disadvantageous that each LED has to be contacted.

DE-A-10 2006 058 509 likewise discloses a circuit with intermediate tapping points.

Circuits of this kind cannot be installed in a small housing of an integrated circuit since they require too many connections.

The object of the disclosure is therefore to create a solution that does not have the above disadvantages of the prior art and has further advantages.

In particular, the object of the disclosure is to create a lighting device, particularly for vehicles, in which a plurality of LED chains can be examined for a short circuit of an individual LED, more specifically with minimal outlay in respect of the circuitry.

In order to achieve this object, the disclosure proposes a lighting device, particularly for vehicles, which is provided with

- at least two LED chains, each of which has a series circuit formed of a plurality of LEDs,
- a multi-channel power supply unit for the at least two LED chains with at least two current sources, wherein each LED chain is associated with a power source and each LED chain is electrically connected on the one hand to a power supply output connection of the power supply unit and on the other hand to a reference potential, and
- a monitoring device for identifying a short circuit in a predefinable number of LEDs of one of the at least two LED chains, wherein the monitoring device is provided with
  - a detector per LED chain for identifying and signalling an interruption in the current flow in said LED chain,
  - a controllable interrupter switch per LED chain, which has a control connection controllable by means of a control signal and a current path which is switched conductively or non-conductively depending on the magnitude of the control signal and which is connected in series with the LED chain, and
- at least one coupling component assembly connected between the control connections of the at least two interrupter switches for enabling a flow of current from the control connection of one interrupter switch to the control connection of the other interrupter switch when a voltage of a value greater than a predefinable switching voltage is applied across the coupling component assembly
- wherein, in the event of a short circuit of the predefined number of LEDs in one of the two LED chains, a voltage at least equal to the switching voltage drops across the coupling component assembly, and therefore the control signal of the interrupter switch associated with the other LED chain assumes a value opening this interrupter switch, such that the detector associated with this other LED chain signals an interruption of the current flow in the other LED chain.

The key feature of the disclosure is to couple to LED chains of an LED lighting device to one another and to provide each LED chain with an interrupter switch. The controllable interrupter switches are coupled to one another by a coupling component assembly. If the voltage difference between the control connections of the interrupter switches of the two LED chains exceeds a predefinable value, which is the case, depending on a specified or desired value, in the event of the short circuit of an individual LED or the short circuit of a predefinable relatively small number of LEDs in one of the LED chains, this disruption and the associated reduction in the voltage across the "disrupted" LED chain translates into a change in the voltage across the coupling component assembly, such that this becomes conductive and therefore activates the interrupter switch of the other LED chain, such that the interrupter switch of this other LED chain opens, which in turn can be detected reliably by the detector associated with this other LED chain.

In accordance with the disclosure the short-circuit of an individual LED or the short circuit of two or fewer LEDs in one of the LED chains is thus converted into an interruption of the other LED chain. The driver for this other LED chain, as explained above, is provided with a corresponding fault detector, which identifies the interruption of the LED chain. Thus, in order to realise the object of the disclosure, merely one interrupter switch per LED chain and a coupling component assembly that must perform the function of being electrically conductive from a predefinable voltage drop are necessary. This is realised in the simplest case by diodes. Ultimately, only few electronic components are thus necessary in order to realise the object of the disclosure as an "add on" so to speak of a current supply unit or, broadly speaking, power supply unit for a multi-channel LED lighting device.

In an advantageous development of the disclosure it can be provided that the coupling component assembly enables a flow of current in one direction or in the other, opposite direction only with a predefinable sign of the voltage dropping across it or depending on the sign of the voltage dropping across it.

In an advantageous example of the disclosure it can be provided that the coupling component assembly has one or more diodes which can be connected anti-parallel in order to enable a flow of current in both directions.

In a further advantageous example of the disclosure it can be provided that the monitoring device, in the case of more than two LED chains, has a number of coupling component assemblies equaling the number of LED chains, wherein the control connections of the interrupter switches associated with the LED chains are coupled cyclically in each case by means of a coupling component assembly and therefore as a ring circuit.

In a further advantageous example of the disclosure it may be provided that each coupling component assembly enables a flow of current in the same direction through the ring circuit.

In an advantageous development of the disclosure it may be provided that the monitoring device UWE, in the case of more than two LED chains, has a number of coupling component assemblies equaling the number of LED chains, wherein the control connections of the interrupter switches associated with the LED chains are coupled in a star circuit by means of the coupling component assemblies (KBA).

In an advantageous example of the disclosure it may be provided that each coupling component assembly enables unidirectional flows of current.

In a further advantageous example of the disclosure it may be provided that the interrupter switches are formed as bipolar, FET or MOS transistors.

As already explained above, the disclosure relates to the power supply for electroluminescent light sources which are formed as circuit assemblies not intended for a specific application. However, it is particularly suitable for application in automotive lights. In the widest sense, the disclosure therefore relates to a monitoring device for assemblies of signal or lighting devices or assemblies of optical signal or lighting devices or of arrangements of lighting devices for the vehicle interior, or of arrangements or a particular design of portable emergency signal devices in vehicles.

As discussed above, the object of the disclosure is therefore to create a solution which does not have the above disadvantages of the prior art and which has further advantages.

The basic concept in this disclosure is that of utilising the identification, provided already, of interruptions of the current path of an LED chain of at least two LED chains $L_1,L_2,L_3$ for identifying a short circuit of an individual LED in another LED chain of the at least two LED chains $L_1,L_2,L_3$. To this end, a special sub-device is necessary, which is inserted between the power supply, typically a current source $IS_1$, $IS_2$, $IS_3$ within an integrated circuit, and which has at least two LED chains $L_1,L_2,L_3$ and couples these such that a short circuit of an individual LED or a short circuit in a few (two, three or four) LEDs in an LED chain leads to an interruption of the flow of current in at least one other LED chain. Since the integrated circuit, at least in applications for the automotive industry, has aids for identifying an interruption in the flow of current in one or more of the connected LED chains $L_1,L_2,L_3$, it is thus able to identify and output a fault. It has been found here that it generally is not important to specify what fault (short circuit of an individual LED or interruption of an LED chain) is present or at which LED chain this fault is present. Thus, this information can be sacrificed in favour of the identification of a short circuit of an individual LED.

A method for detecting the failure of an individual LED in a lighting device having at least two LED chains $L_1,L_2,L_3$ is therefore proposed, which method as a first step provides the detection of an individual LED short circuit in a first LED chain of the at least two LED chains $L_1,L_2,L_3$ by a first detection means and an interruption, caused by this detection, of the flow of current through at least one other LED chain of the at least two LED chains $L_1,L_2,L_3$ by an interruption means. The following text shall disclose that a first transistor $T_1$ and first diode $D_1$ in conjunction with a first resistor $R_1$, as shown in FIG. 3 for example, are proposed as first detection means in the exemplary example presented here. The corresponding detection means of the other LED chain of the at least two LED chains $L_1,L_2,L_3$ is proposed as interruption means. In the examples presented here, the transistor thus performs a dual function as detection means and as interruption means. This does not necessarily have to be the case. As an anticipatory example, reference is made here already to a transistor $T_2$ in FIG. 3 by way of illustration. Thus, once the flow of current has passed through the other LED chain of the at least two LED chains, the short circuit of an individual LED is converted into an LED chain interruption in another LED chain. The measurability and thus the detectability by the integrated circuit are hereby provided, which solves the technical problem. The last step is therefore detection of the interruption of the flow of current through the other LED chain of the at least two LED chains $L_1,L_2,L_3$.

To summarise, the proposed device for supplying at least two LED chains $L_1,L_2,L_3$ with electricity is characterised in that it has a sub-device StOC, which, in the event of the short circuit of one or more LEDs within a first LED chain of the at least two LED chains $L_1,L_2,L_3$, brings about an identification and/or subsequent signalling of an interruption of the current path within another LED chain of these at least two LED chains $L_1,L_2,L_3$, referred to hereinafter as the second LED chain. A precondition is that the proposed device has measurement means $MI_1,MU_1$; $MI_2,MU_2$; $MI_3,MU_3$ for detecting an interruption of an LED chain and suitable signalling means for being able to forward (signal) the detection result to a control device.

The particular advantage here lies in the conversion of the manifestation of a short circuit of an individual LED into the interruption of an LED chain, detectable by the integrated circuit (the device).

A further example of the proposed device is characterised in that a transistor $T_1,T_2,T_3$ is disposed in each current path of each LED chain of these at least two LED chains $L_1,L_2,L_3$. Here, the transistor $T_1,T_2,T_3$ is preferably a bipolar transistor. Each transistor $T_1,T_2,T_3$ is part of the sub-device. In the event of fault-free operation, each transistor $T_1,T_2,T_3$ is conductive. At least one transistor $T_1,T_2,T_3$ of the second LED chain of the at least two LED chains $L_1,L_2,L_3$, hereinafter referred to as the second transistor, is switched to be blocking if, in a first LED chain of the at least two LED chains $L_1,L_2,L_3$, a short circuit SC along the LED chain occurs. This construction has the advantage that it is very compact and can be provided with few components.

A further example of the proposed device is characterised in that the at least one transistor of the first LED chain of the at least two LED chains $L_1,L_2,L_3$, referred to hereinafter as the first transistor, is a bipolar transistor $T_1,T_2,T_3$, and in that the at least one second transistor of the second LED chain of the at least two LED chains $L_1,L_2,L_3$ likewise is a bipolar transistor $T_1,T_2,T_3$. Here, the base of the first transistor is connected to the base of the second transistor via at least one diode $D_1,D_2,D_3,D_{11},D_{12},D_{21},D_{22},D_{31},D_{32}$ directly or indirectly, in particular via a series resistor $R_{v1},R_{v2}$. The base of the first transistor is energised by means of an operating point setting so as to safely connect through the transistor in normal operation. It is particularly advantageous if this operating point setting is made via an operating point resistor $R_1,R_2,R_3$ which connects the control connection (the base or the gate) of the first transistor to the power source $IS_1,IS_2,IS_3$ of the first LED chain in the current path of which the first transistor is located.

The advantage of this arrangement is that the first transistor is conductive in normal operation and the base current in the event of a fault can be siphoned off through the base-emitter diode of the corresponding transistor of the other LED chain in the event of a short circuit to an individual LED, whereby the first transistor begins to block. Since MOS transistors first are not current-controlled and second do not have the necessary base-emitter diode, which performs the actual LED short-circuit detection, the detection function for an individual LED short circuit and the interruption function for the interruption of the flow of current through the LED chain must be separated in the case of the use of MOS transistors. The detection function is performed then by a separate detection device. This may be a separate PN diode, i.e. an auxiliary diode, for example. This auxiliary diode $d_1,d_2,d_3$ is necessary as detection device if a MOS transistor is used as transistor $T_1,T_2,T_3$ instead of a bipolar transistor. The auxiliary diode in question is then connected between the gate of the MOS transistor as second node $K_{12},K_{22},K_{23}$ of the LED chain in question and the connection node $K_{13},K_{23},K_{33}$ between MOS transistor $T_1,T_2,T_3$ and the LED chain in question. The polarity of the auxiliary diode $d_1,d_2,d_3$ is selected in accordance with the transistor type at the time of connection. The auxiliary diode $d_1,d_2,d_3$ of the LED chain in question then emulates the function of the base-emitter diode of a bipolar transistor as detection device and forces the potential of a transistor of another channel to a potential at which the gate-source path no longer has sufficient voltage, whereby this starts to block if there is a short circuit of an individual LED or a number of LEDs along the LED chain in question. With the use of MOS transistors, the functions of the detection device (first auxiliary diode) and interruption device (transistor) are thus separated, whereas in the case of bipolar transistors they can be carried out by the bipolar transistors simultaneously (transistor alone). With use of a bipolar transistor as a transistor $T_1,T_2,T_3$, the auxiliary diode $d_1,d_2,d_3$ therefore is not absolutely necessary. A construction with auxiliary diodes and MOS transistors is therefore particularly advantageous because it enables a complete integration in integrated CMOS circuits within the scope of CMOS standard processes.

A further example of the proposed device is characterised in that the device links a plurality of LED chains to one another. Here, the device now comprises at least three LED chains $L_1,L_2,L_3$. The example of the device relates to a specific topology of the connection of the short-to-open converter StOC. In each current path of each LED chain of these at least three LED chains $L_1,L_2,L_3$ there is a transistor $T_1,T_2,T_3$, in particular a bipolar transistor. Each transistor $T_1,T_2,T_3$ is again part of the sub-device. Each transistor $T_1,T_2,T_3$ is again connected here such that it is conductive in fault-free operation. In the event of a fault constituted by a short circuit along an LED chain, at least one of the transistors $T_1,T_2,T_3$ of the LED chains not affected by the short-circuit is always switched to be blocking. This occurs if, in at least one other LED chain of the at least three LED chains $L_1,L_2,L_3$ which it is not the LED chain of the transistor switched to be blocking, a short circuit occurs along the LED chain. The control connection (base or gate) of each transistor of a preceding LED chain is connected here to the control connection (base or gate) of the following transistor via at least one diode $D_1,D_2,D_3,D_1,D_{12},D_{21},D_{22},D_{31},D_{32}$ directly or indirectly, in particular via a resistor $R_{v1},R_{v2},R_{v3}$. The words "preceding" and "following" relate here to a virtual numbering of the m LED chains from 1 to m.

Here, each LED chain follows an LED chain with a lower number and precedes an LED chain with a higher number. The first LED chain shall be understood here to be the chain following the $m^{th}$ LED chain, and the $m^{th}$ LED chain to be the chain preceding the first LED chain. All elements of a preceding LED chain are therefore referred to here as "preceding". All elements of a following LED chain are referred to as following. The control connection (base or gate) of the preceding transistor is energised by means of an operating point setting. The control connection (base or gate) of the preceding transistor is particularly preferably connected via an operating point resistor $R_1,R_2,R_3$ to the power source $IS_1,IS_2,IS_3$ of the associated LED chain in the current path of which the preceding transistor is disposed. In the case of a MOS transistor as following transistor the control connection (base or gate) of the following transistor is connected to a connection of the following LED chain, to which it is connected, via an associated following auxiliary diode. In the case of a MOS transistor as preceding transistor, the control connection (bass or gate) of the preceding transistor is connected to a connection of the preceding LED chain, to which it is connected, via an associated preceding auxiliary diode. The particular feature of this example of the device is that the diodes are connected such that they allow a circular flow of current through the diodes. The channels are thus connected to one another in a ring.

A further example of the proposed device is characterised in that the device likewise has at least three LED chains $L_1,L_2,L_3$ and instead of being connected in ring form, as described before, are now connected to one another in a star shape via diodes. In each current path of each LED chain of these three LED chains $L_1,L_2,L_3$ there is again a transistor $T_1,T_2,T_3$, in particular a bipolar transistor or MOS transistor with a control connection (base or gate) and in each case two further connections. Each transistor $T_1,T_2,T_3$ is again part of the corresponding sub-device. Each transistor $T_1,T_2,T_3$ is again connected such that it is conductive in fault-free operation. Again, at least one of these transistors $T_1,T_2,T_3$ is always switched to be blocking if, in at least one other LED chain of the at least three LED chains $L_1,L_2,L_3$ which is not the LED chain of the transistor switched to be blocking, a short circuit occurs along the LED chain in question. The control connection (base or gate) of each transistor of a preceding LED chain is now connected, however, to the control connection (base or gate) of the following transistor via at least two diode pairs $D_{11},D_{12}$; $D_{21},D_{22}$; $D_{31},D_{32}$ connected one after the other in series and formed in each case of two diodes $D_{11},D_{12}$; $D_{21},D_{22}$; $D_{31},D_{32}$ connected anti-parallel. The diodes have two connections. Each diode may be connected in series with a resistor. The control connection (base or gate) of the preceding transistor is energised by means of an operating point setting. This energisation is preferably provided in such a way that the control connection (base or gate) of the preceding transistor is connected via an operating point resistor $R_1,R_2,R_3$ to the power source $IS_1,IS_2,IS_3$ of the associated LED chain in the current path of which the preceding transistor is disposed. In the case of a MOS transistor as following transistor, the control connection (base or gate) of the following transistor is connected to a connection of the following LED chain, to which it is connected, via an associated following auxiliary diode. In the case of a MOS transistor as preceding transistor, the control connection (base or gate) of the preceding transistor is connected to a connection of the preceding LED chain, to which it is connected, via an associated preceding auxiliary diode. The diodes are connected here such that they are connected to a connection with a common star point (SP).

The disclosure will be explained in greater detail hereinafter on the basis of a number of exemplary examples and with reference to the drawings, in which, specifically:

Figure 1:
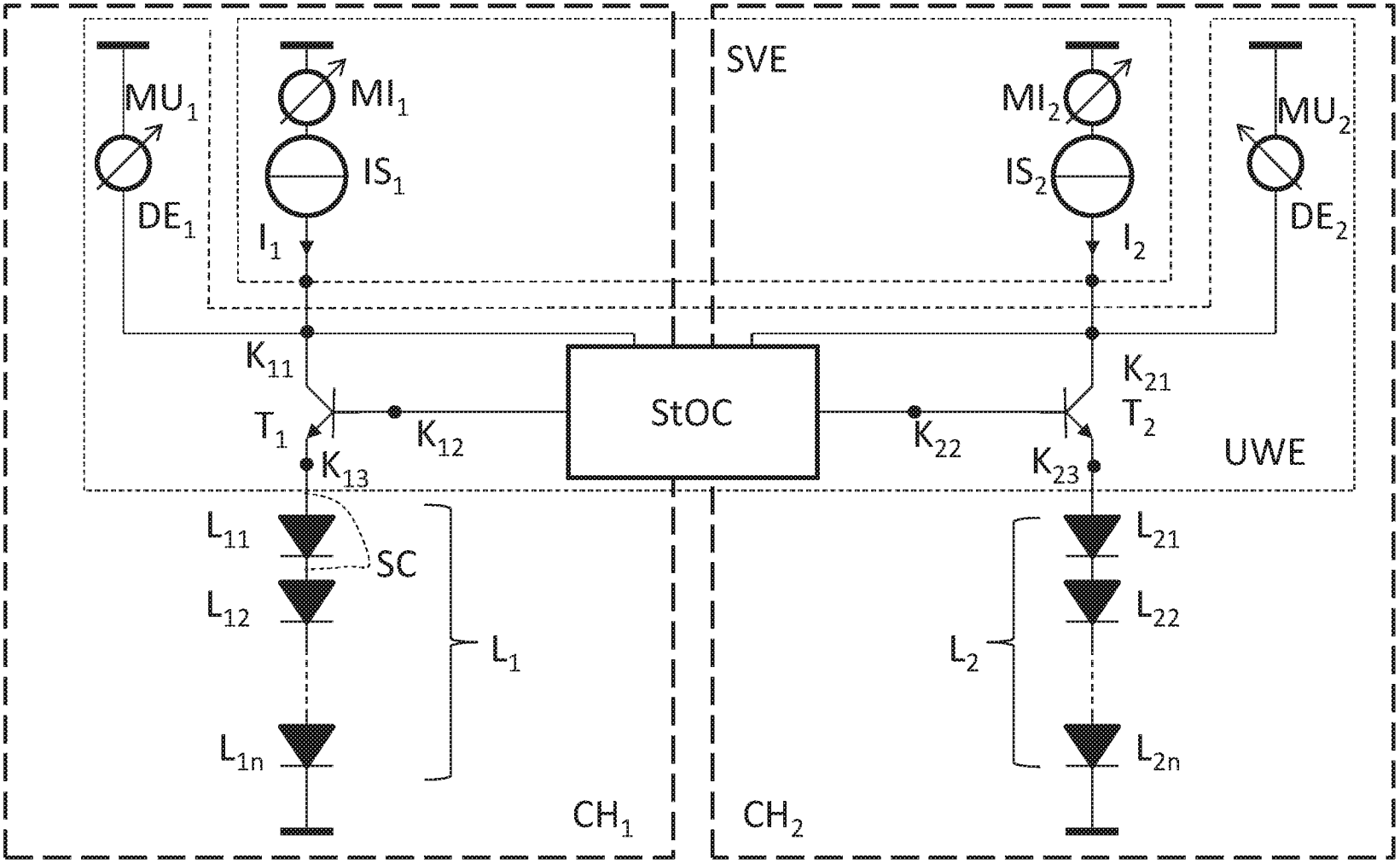
FIG. 1 shows in a schematically simplified manner the basic principle of the proposed technical solution with a short-to-open converter StOC.

FIG. 1 shows the primary concept of the solution of the proposed device and the proposed method. A first lighting channel $CH_1$ comprises the first power source—here the first current source $IS_1$—the first LED chain $L_1$ with the LEDs $L_{11},L_{12}, \ldots, L_{1n}$ and first measurement means $MI_1,MU_1$. The first channel, in this example, comprises a first current measurement means $MI_1$, which detects the value of the first electrical current $I_1$ fed into the first LED chain $L_1$ by the power source. A first detector $DE_1$ in the form of a first voltage measurement means $MU_1$ detects the voltage drop across the first LED chain $L_1$. The first channel $CH_1$ typically comprises at least one of these first measurement means: in other words, at least the first current measurement means $MI_1$ or the first voltage measurement means $MU_1$, so as to be able to detect an interruption to the first LED chain $L_1$. A second lighting channel $CH_2$ comprises the second power source—here the second current source $IS_2$—the second LED chain $L_2$ with the LEDs $L_{21},L_{22}, \ldots, L_{2n}$ and second measurement means $MI_2,MU_2$. The second channel $CH_2$ in this example comprises a second current measurement means $MI_2$, which detects the value of the second electrical current $I_2$ fed into the second LED chain $L_2$ by the second power source. A second voltage measurement means $MU_2$ detects, as detector $DE_2$, the voltage drop across the second LED chain $L_2$. The second channel $CH_2$ typically comprises at least one of these second measurement means: in other words the second current measurement means $MI_2$ or the second voltage measurement means $MU_2$ (detector $D_2$), so as to be able to detect an interruption of the second LED chain $L_2$.

Between the (multi-channel) current supply unit SVE and the LED chains $L_1$, $L_2$ there is arranged a monitoring device UWE, in which a short circuit of an LED or a few LEDs in one of the LED chains is "converted" in accordance with the disclosure into an interruption of another of the LED chains, which is identified by the detector associated with this interrupted LED chain. The monitoring device UWE thus has a short-to-open converter StOC, which connects one end of the first LED chain $L_1$ in normal operation electrically conductively to the first power source, here the first current source $IS_1$, and one end of the second LED chain $L_2$ in normal operation electrically conductively to the second power source, here the second current source $IS_2$. The short-to-open converter StOC particularly preferably evaluates the potential of the third node $K_{13}$ of the first lighting channel ($CH_1$) relative to a reference potential—preferably ground. Depending on the electrical potential of the third node $K_{13}$ of the first lighting channel $CH_1$ relative to the reference potential, the short-to-open converter StOC interrupts the electrical connection between the second power source, here the second current source $IS_2$, and the second LED chain $L_2$. The second measurement means, the second voltage measurement means $MU_2$ and/or the second current measurement means $MI_2$, i.e. the second detector $DE_2$, are hereby put in a position to detect this interruption and to provide a corresponding error signal. The short-to-open converter StOC particularly preferably acts symmetrically. In other words, if the voltage drop across the second LED chain $L_2$ changes beyond a certain extent, the short-to-open converter StOC separates the electrical connection between the first power source, here the first current source $IS_1$, and the first LED chain $L_1$ similarly. The first measurement means, the first voltage measurement means $MU_1$ and/or the first current measurement means $MI_1$, i.e. the first detector $DE_1$ are hereby similarly put in a position to detect this interruption and to provide a corresponding error signal.

Figure 2:
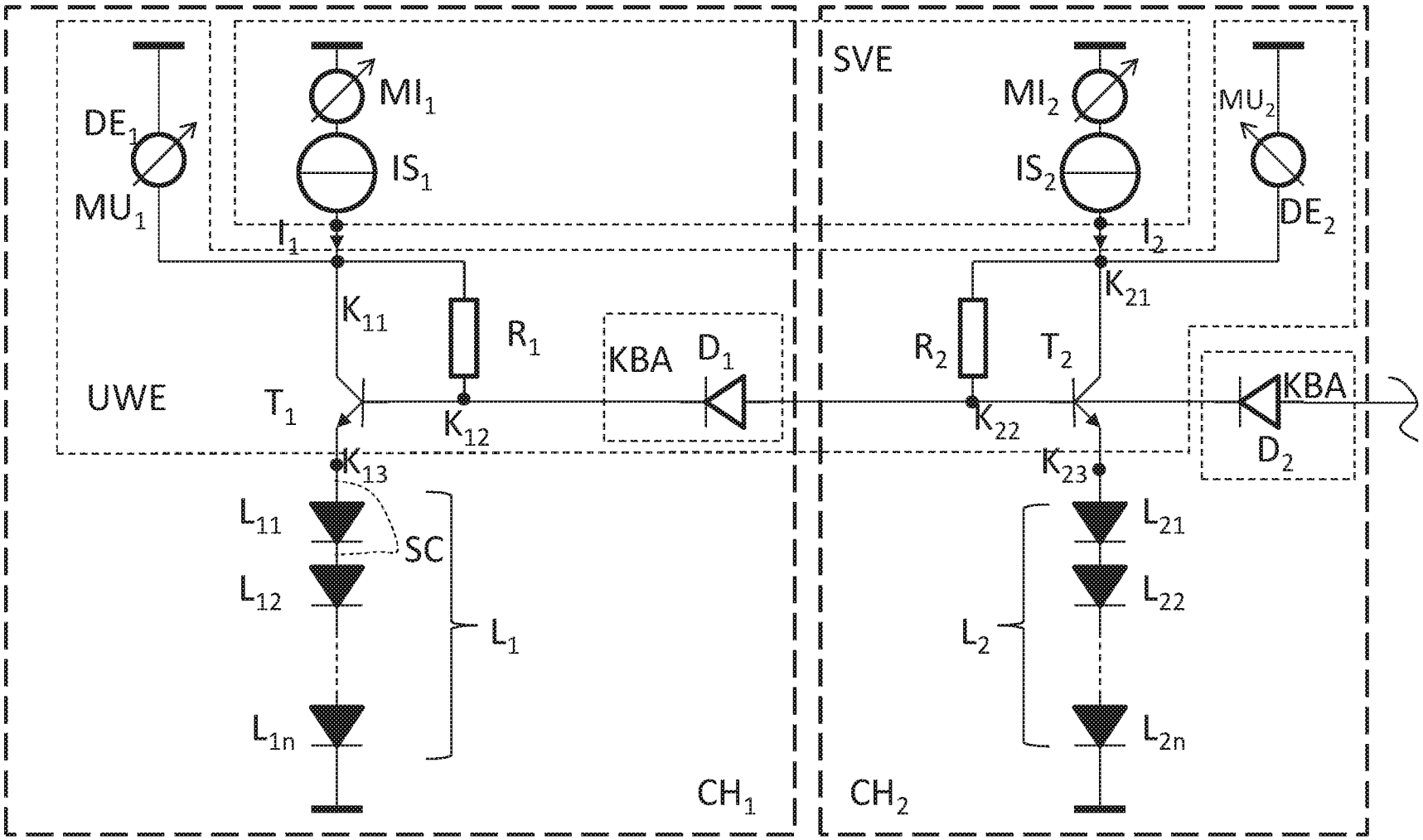
FIG. 2 shows a simple more specific example of the proposed solution with NPN bipolar transistors.

FIG. 2 shows a simple realisation of this principle. Here, the first LED chain $L_1$ is monitored for short circuits of individual LEDs, whereas the second LED chain $L_2$ is used for signalling.

The structure of the part of the monitoring device UWE associated with the first channel $CH_1$ will be described first.

A first transistor $T_1$ (first interrupter switch) is in this example an NPN bipolar transistor. This is connected to its collector by means of a first node $K_{11}$ of the first channel $CH_1$. The first voltage measurement means $MU_1$ (first detector $DE_1$) and the first current source $IS_1$ as first power source are also optionally connected by means of this first node $K_{11}$ of the first channel $CH_1$. The first current measurement means $MI_1$ optionally provided is connected in series with the first current source $IS_1$. The order of first current source $IS_1$ and first current measurement means $MI_1$ can be varied. The first node $K_{11}$ of the first channel $CH_1$ is connected to the base of the first transistor $T_1$ by means of a first resistor $R_1$. The operating point of the first transistor $T_1$ is hereby set. The first resistor $R_1$ energises the base-emitter diode of the first transistor $T_1$, which is thus conductive in the normal state. The emitter of the first transistor $T_1$ at $K_{13}$ is connected to one end of the first LED chain $L_1$. This connection is the third electrical node $K_{13}$ of the first channel $CH_1$. The other end of the first LED chain $L_1$ is connected to the reference potential, here to ground. The base of the first transistor $T_1$ forms the second electrical node $K_{12}$ of the first channel $CH_1$.

The structure of the part of the monitoring device UWE associated with the second channel $CH_2$ will now be described.

A second transistor $T_2$ (second interrupter switch) is in this example likewise an NPN bipolar transistor. This is connected to its collector by means of a second node $K_{21}$ of the second channel $CH_2$. The second voltage measurement means $MU_2$ (second detector $DE_2$) and the second current source $IS_2$ as first power source are also optionally connected by means of this second node $K_{21}$ of the first channel $CH_2$. The second current measurement means $MI_2$ optionally provided is connected in series with the second current source $IS_2$. The order of second current source $IS_2$ and second current measurement means $MI_2$ can be varied. The first node $K_{21}$ of the second channel $CH_2$ is connected to the base of the second transistor $T_2$ by means of a second resistor $R_2$. The operating point of the second transistor $T_2$ is hereby set. The second resistor $R_2$ energises the base-emitter diode of the second transistor ($T_2$), which is thus conductive in the normal state. The emitter of the second transistor $T_2$ is connected to one end of the second LED chain $L_2$. This connection is the third electrical node $K_{23}$ of the second channel $CH_2$. The other end of the second LED chain $L_2$ is connected to the reference potential, here to ground. The base of the second transistor $T_2$ forms the second electrical node $K_{22}$ of the second channel $CH_2$.

The monitoring device UWE has, as coupling component assembly KBA connected between the base connections $K_{12}$, $K_{21}$ of the transistors $T_1$, $T_2$, a first diode $D_1$, which connects the base of the first transistor $T_1$, i.e. the second node $K_{12}$ of the first channel $CH_1$, to the base of the second transistor $T_2$, i.e. the second node $K_{22}$ of the second channel $CH_2$. The electrical connection between the second node $K_{12}$ of the first channel $CH_1$ and the second node $K_{22}$ of the second channel $CH_2$ is normally interrupted due to the diode $D_1$, since the voltage drop across the first LED chain $L_1$ and the second LED chain $L_2$ should be the same with the same energisation, and therefore the voltage difference across the diode $D_1$ causing a flow of current through the diode $D_1$ does not drop, i.e. the threshold voltage of the diode is not reached. Here, symmetrical conditions are firstly assumed. This means the same number n of LEDs in the two LED chains and the same first current $I_1$ and second current $I_2$. Due to the currents $I_1$,$I_2$ of the two current sources $IS_1$,$IS_2$ set to the same values, the same electrical potential is defined for the respective third nodes $K_{13}$,$K_{23}$ of the first channel $CH_1$ and the second channel $CH_2$ with the same LEDs and same LED number. If the resistance value of the first resistor $R_1$ is selected to be equal to the resistance value of the second resistor $R_2$, the base-emitter diode of the first transistor $T_1$ is energised with the same current as the base-emitter diode of the second transistor $T_2$. For the sake of simplicity, it is assumed here that the first transistor $T_1$ has properties that are the same as the properties of the second transistor $T_2$. Thus, identical base-emitter voltages drop across the base-emitter diode sections. In this case, in normal operation, the potential therefore must be the same on both sides of the first diode $D_1$, and no current flows. In reality none of the resistors $R_1$,$R_2$, the transistors $T_1$,$T_2$, or the LEDs of the LED chains $L_1$;$L_2$ are identical, and instead differ from one another. It is therefore expedient to select the switching voltage of the first diode $D_1$ or the coupling component assembly KBA suitably. Zener diodes may be used optionally, or series connections of diodes. In some cases it may be expedient, instead of silicon diodes, to use germanium diodes or other diodes modified suitably in respect of their switching voltage by suitable materials. In any case it should be clarified, by means of a (for example Monte Carlo) simulation, which diode switching voltages require the scattering of the components. This is different, however, depending on the application and therefore will not be discussed here in further detail.

In the case of a short circuit of an individual LED (FIG. 2 by way of example shows a short circuit SC of the first LED $L_{11}$ of the first LED chain $L_1$) the flow of current through the first LED chain $L_1$ remains at the current value of the first current $I_1$ of the first current source $IS_1$. The potential of the third node $K_{13}$ of the first channel $CH_1$ relative to the reference potential drops by an LED switching voltage, i.e. by the voltage that drops across each of the preferably identical LEDs when current is first passed through them. So that the value of the potential of the second node $K_{12}$ of the first channel $CH_1$ relative to ground thus also decreases by exactly this value, it is coupled by the enforced fixed voltage drop across the base-emitter diode of the first transistor $T_1$ to the potential of the third node $K_{13}$ of the first channel. There is thus a (increased) voltage difference between the second node $K_{22}$ of the second channel $CH_2$ and the second node $K_{12}$ of the first channel $CH_1$ and therefore a (increased) voltage difference over the coupling component assembly KBA. This voltage difference is in the flow direction of the first diode $D_1$. With a suitable selection of the switching voltage of the coupling component assembly KBA (first diode $D_1$), this starts to become conductive. The switching voltage of the first diode $D_1$ should therefore be less than or equal to the switching voltages of the used LEDs in the first LED chain $L_1$. It preferably lies between 5% and 90% lower than the switching voltage of the LEDs. The first diode can optionally also be replaced by an electrical circuit of identical effect with amplifiers, etc., which shows a suitable switching voltage. If reference is thus made here to the first diode $D_1$, this relates to the effect of this component or a circuit replacing this component, i.e. to any kind of coupling component assembly KBA, which is conductive from a predefined switching voltage.

If the first diode $D_1$ now opens, the current that previously was drained off through the base-emitter diode of the second transistor $T_2$ thus drains off across the base-emitter diode of the first transistor $T_1$. The second transistor is thus less conductive, whereby the potential of the third node $K_{23}$ of the second channel $CH_2$ decreases. Due to the great amplification of the current and the great differential resistance of the LEDs of the second LED chain $L_2$, the second LED chain $L_2$ is switched off ($T_2$ opens). The current reduction of the current of the second current source $IS_2$ hereby decreases, and this can be detected by the second measurement means $MI_2$,$MU_2$ (detector $DE_2$). Due to this detection, an interruption is then typically detected and optionally signalled.

The remaining second diode $D_2$ of the second channel $CH_2$ is used only to clarify a potential connection possibility (coupling in each case of two LED chains where multiple LED chains are provided).

Example Calculation

On the exemplary assumption that the forward voltage of an LED is 3V, the potential of the third node $K_{13}$ of the first channel $CH_1$ is n*3V. It is assumed by way of example that n=5 for the calculation. Thus, 15 V drop across the first LED chain $L_1$ between the third node $K_{13}$ of the first channel and ground. 0.7 V for example will drop across the base-emitter diode of the first transistor $T_1$. The potential of the second node $K_{12}$ of the first channel $CH_1$ in normal operation thus lies at 15.7 V against ground potential. The same is true similarly for the potential of the second node $K_{22}$ of the second channel $CH_2$ in normal operation, which thus lies likewise at 15.7 V against ground potential. If the first LED $L_{11}$ is now short-circuited by a short circuit SC, the potential of the third node $K_{13}$ of the first channel $CH_1$ thus drops by an LED switching voltage=3 V. It is thus at 12 V. It follows that the potential of the second node $K_{12}$ of the first channel $CH_1$ then lies only at 12.7 V. 15.7 V-12.7 V=a drop of 3 V, i.e. an LED threshold voltage across the first diode $D_1$, whereupon this starts to become conductive because its threshold voltage, i.e. the switching voltage of the, generally expressed, coupling component assembly KBA in this example lies at 0.7 V. The potential of the second node $K_{22}$ of the second channel, however, is then determined by the voltage drop across the first diode $D_1$. If the switching voltage thereof is again for example 0.7 V, the potential of the second node $K_{22}$ of the second channel $CH_2$ is thus merely 13.4 V instead of 15.7 V. The potential of the third node $K_{23}$ of the second channel $CH_2$ hereby must lie 0.7 V lower in accordance with the base-emitter voltage of the second transistor $T_2$ at 12.7 V. Due to the steep characteristic curve of the LEDs in the second LED chain $L_2$, the current reduction at the second current source $IS_2$ thus decreases. This can be detected by the second measurement means $MI_2$, $MU_2$ (detector $DE_2$). This reduction of the second current $I_2$ can be detected directly by the second current measurement means $MI_2$ or as a changing voltage drop across the second current source $IS_2$. The conditions correspond to an interruption of the second LED chain $L_2$ and are identified as such by the second measurement means of the second channel $CH_2$.

Figure 3:
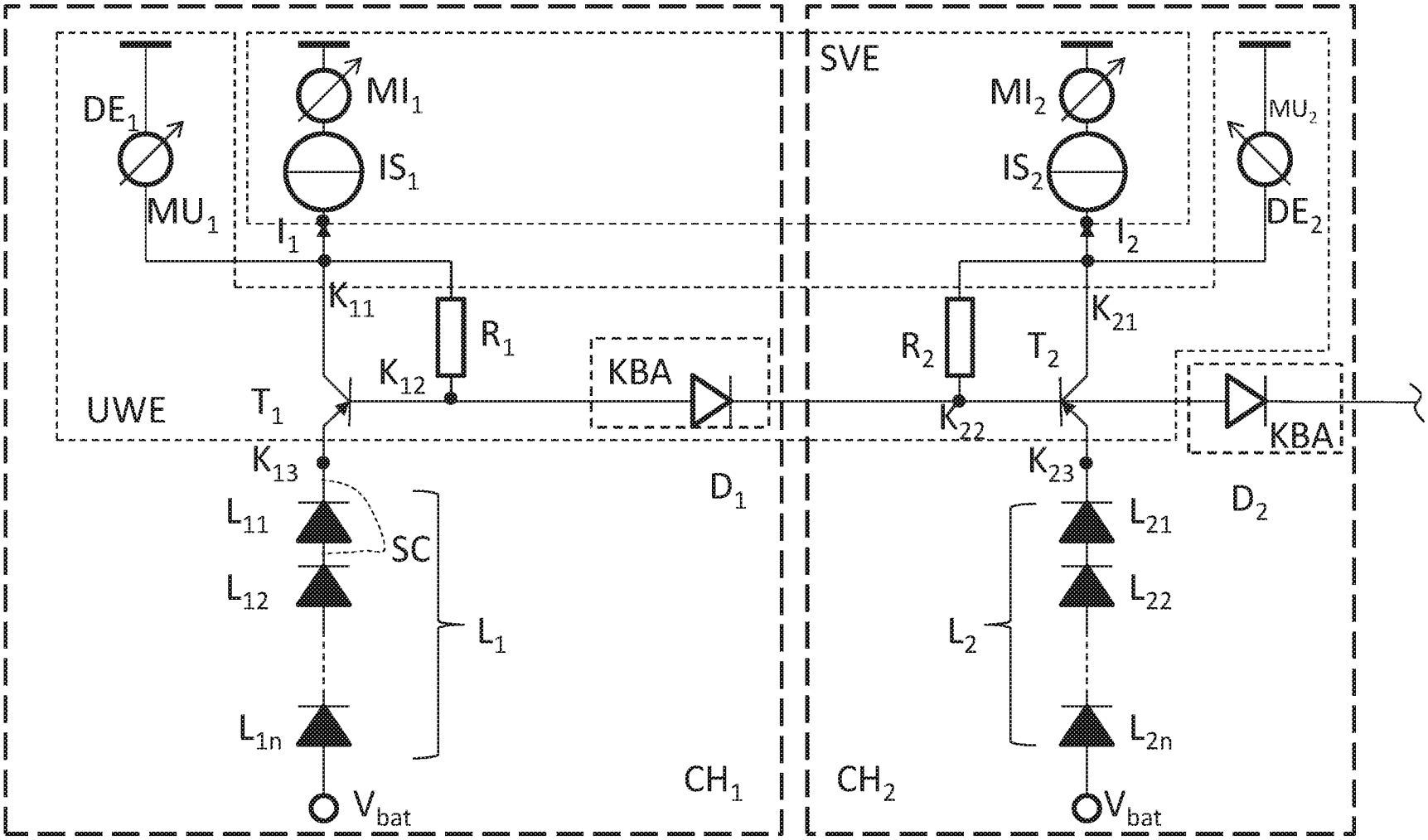
FIG. 3 shows a simple more specific example of the proposed solution with PNP bipolar transistors.

FIG. 3 corresponds substantially to FIG. 2. The LED chains, however, are connected to the supply voltage "in reverse". The supply voltage $V_{bat}$ is now used as a reference potential. The first transistor $T_1$ and the second transistor $T_2$ are now PNP transistors by way of example. The first diode $D_1$ is likewise rotated in order to produce functional capability. The operating principle, however, is otherwise similar to that of FIG. 2.

Figure 4:
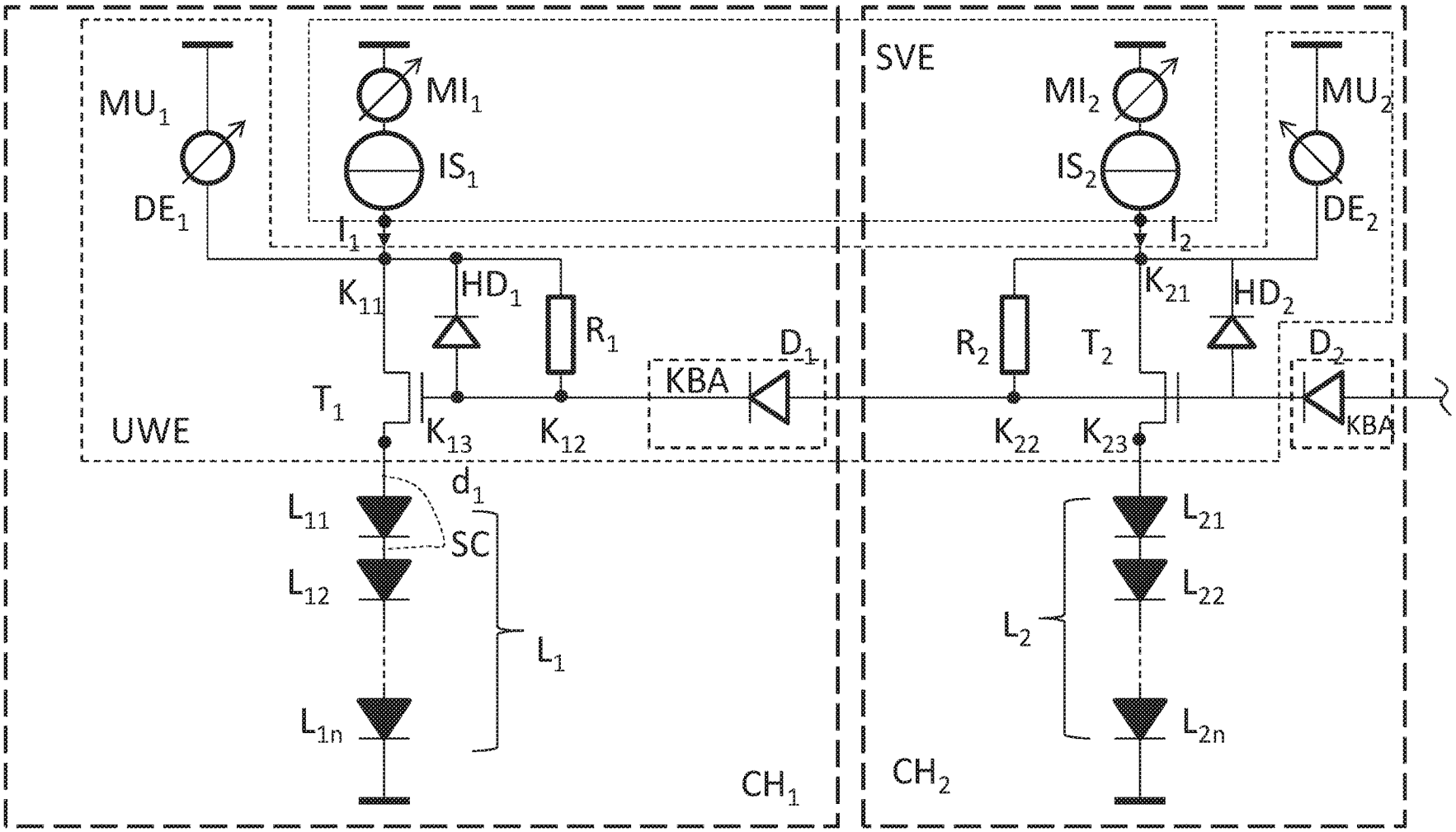
FIG. 4 shows a simple more specific example of the proposed solution with N-channel MOS transistors.

FIG. 4 corresponds to FIG. 2, with the difference that N-channel MOS transistors are used instead of the NPN bipolar transistors for the first transistor $T_1$ and the second transistor $T_2$. In order to couple the second node $K_{12}$ of the first channel $CH_1$ to the third node $K_{13}$ of the first channel in respect of the voltage difference between these two nodes, the function of the omitted base-emitter diode must be replaced. This is achieved by a first auxiliary diode $HD_1$. The flow of current across the first auxiliary diode $HD_1$ is adjusted via the first resistor $R_1$, such that the first auxiliary diode is open in normal operation. The first transistor $T_1$ is preferably installed such that the source of the first transistor $T_1$ is connected to the third node $K_{13}$ of the first channel $CH_1$.

Figure 5:
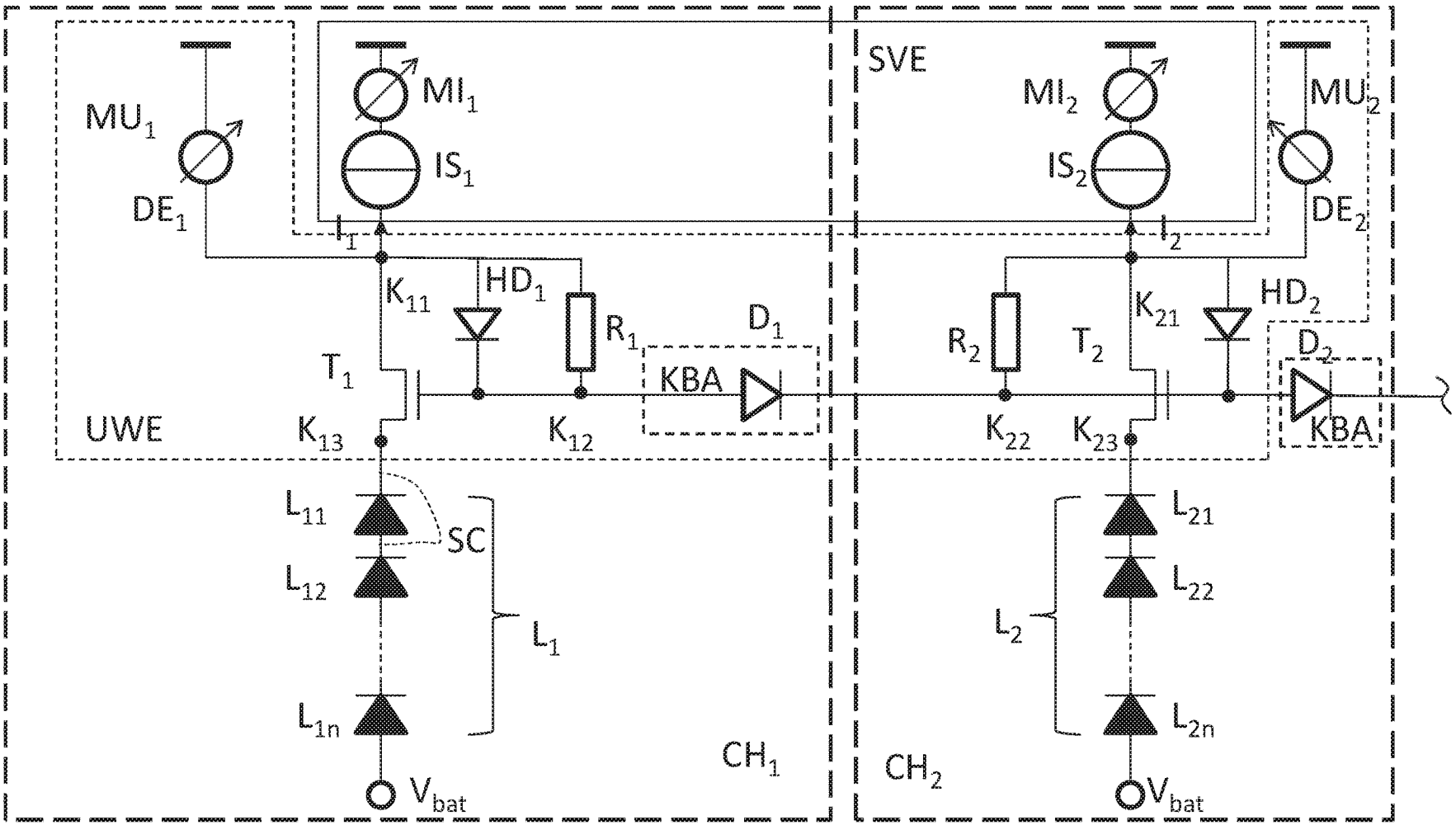
FIG. 5 shows a simple more specific example of the proposed solution with P-channel MOS transistors.

FIG. 5 corresponds to FIG. 3, with the difference that P-channel MOS transistors are used instead of the PNP bipolar transistors for the first transistor $T_1$ and the second transistor $T_2$. In order to couple the second node $K_{12}$ of the first channel $CH_1$ to the third node $K_{13}$ of the first channel in respect of the voltage difference between these two nodes, the function of the omitted base-emitter diode must be replaced. This is achieved by a first auxiliary diode $HD_1$. The flow of current across the first auxiliary diode $HD_1$ is adjusted via the first resistor $R_1$, such that the first auxiliary diode is open in normal operation. The first transistor $T_1$ is preferably installed such that the source of the first transistor $T_1$ is connected to the third node $K_{13}$ of the first channel $CH_1$.

Figure 6:
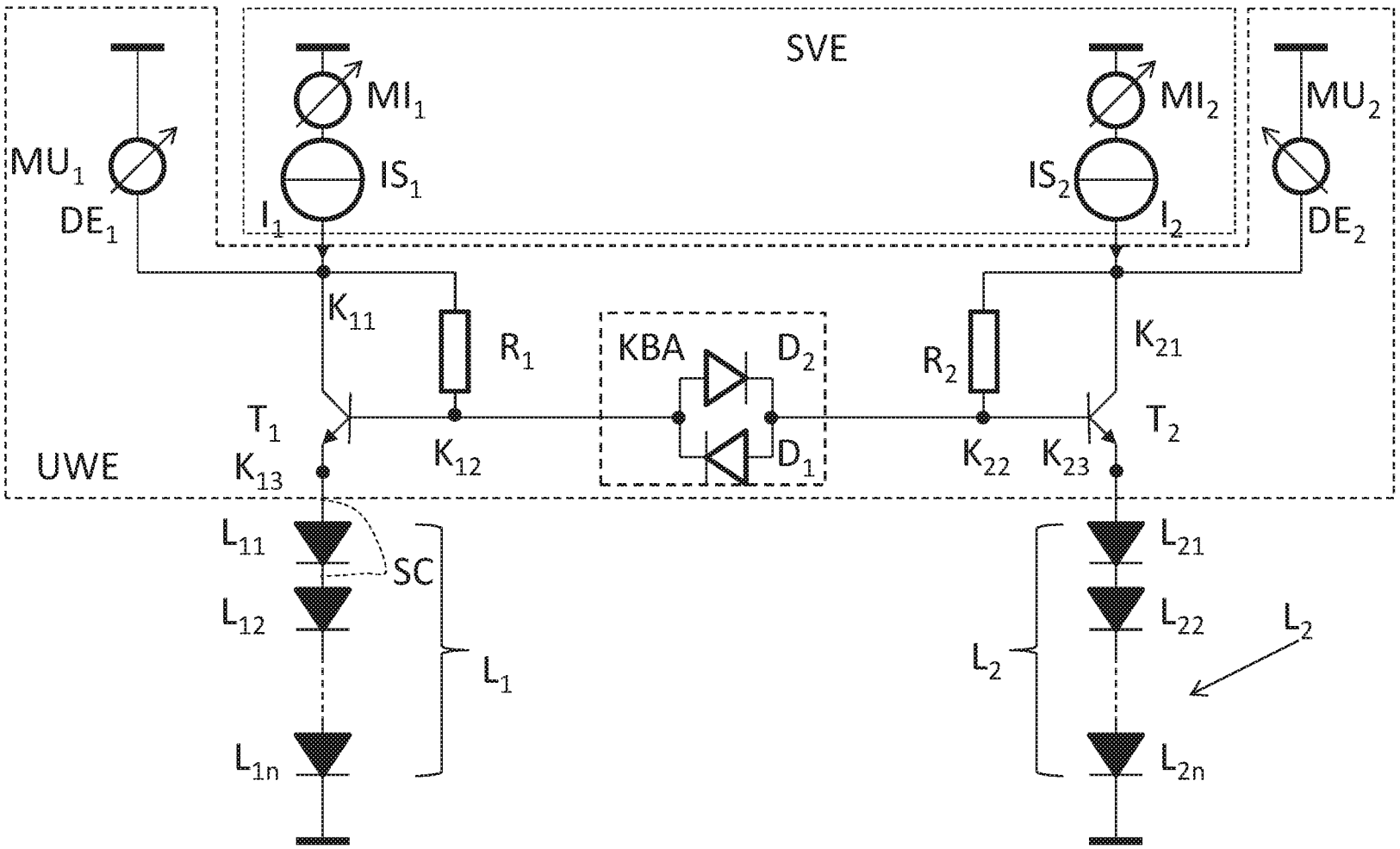
FIG. 6 shows a circuit assembly corresponding to that of FIG. 2 with the difference that the sub-device which forms the short-to-open converter StOC acts in both directions.
Figure 7:
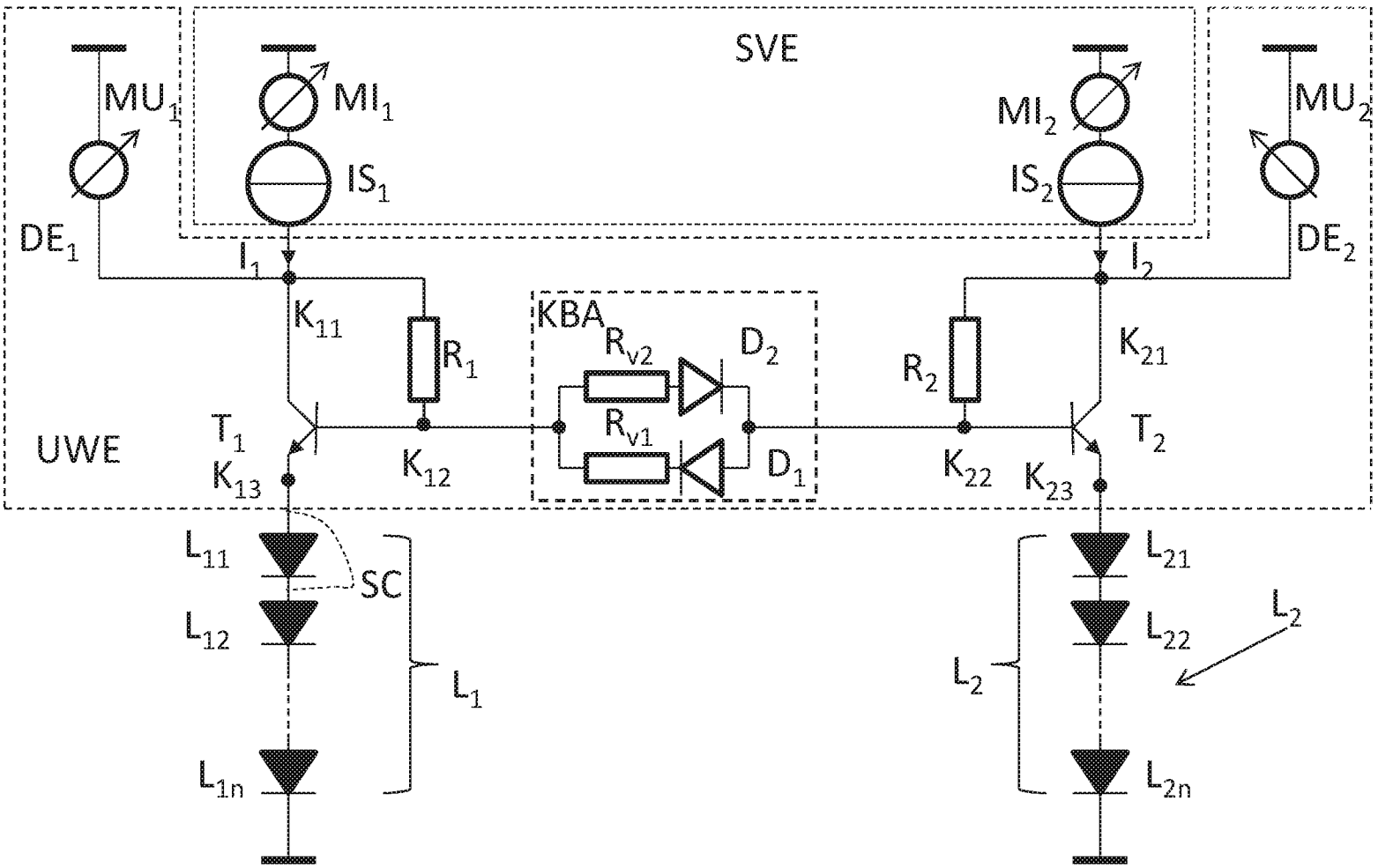
FIG. 7 shows a circuit assembly corresponding to that of FIG. 6 with the difference that an asymmetry of the LED chains can be compensated for by series resistors of the diodes.

FIG. 6 corresponds to FIG. 2, with the difference that the coupling component assembly KBA has a second diode $D_2$, which is connected anti-parallel relative to the first diode $D_1$. The second channel $CH_2$ in the event of a short circuit to an individual LED in the second LED chain $L_2$ can now hereby also interrupt the flow of current in the first channel $CH_1$ and thus bring about the detection of an interruption in the LED chains via the first channel $CH_1$. FIG. 7 corresponds to FIG. 6, with the difference that the first diode $D_1$ and the second diode $D_2$ of the coupling component assembly KBA are each provided with a series resistor $R_{v1}$, $R_{v2}$. These series resistors make it possible to make the circuit asymmetrical. This is necessary in particular if the LED chains are different or the nominal currents $I_1$, $I_2$ are unequal already in normal operation. The possibility of replacing the first diode $D_1$ and/or the second diode $D_2$ by more complex circuits of equivalent effect has already been discussed above. In reality it may be expedient if the first diode $D_1$ has a different switching voltage as compared to the second diode $D_2$.

Figure 8:
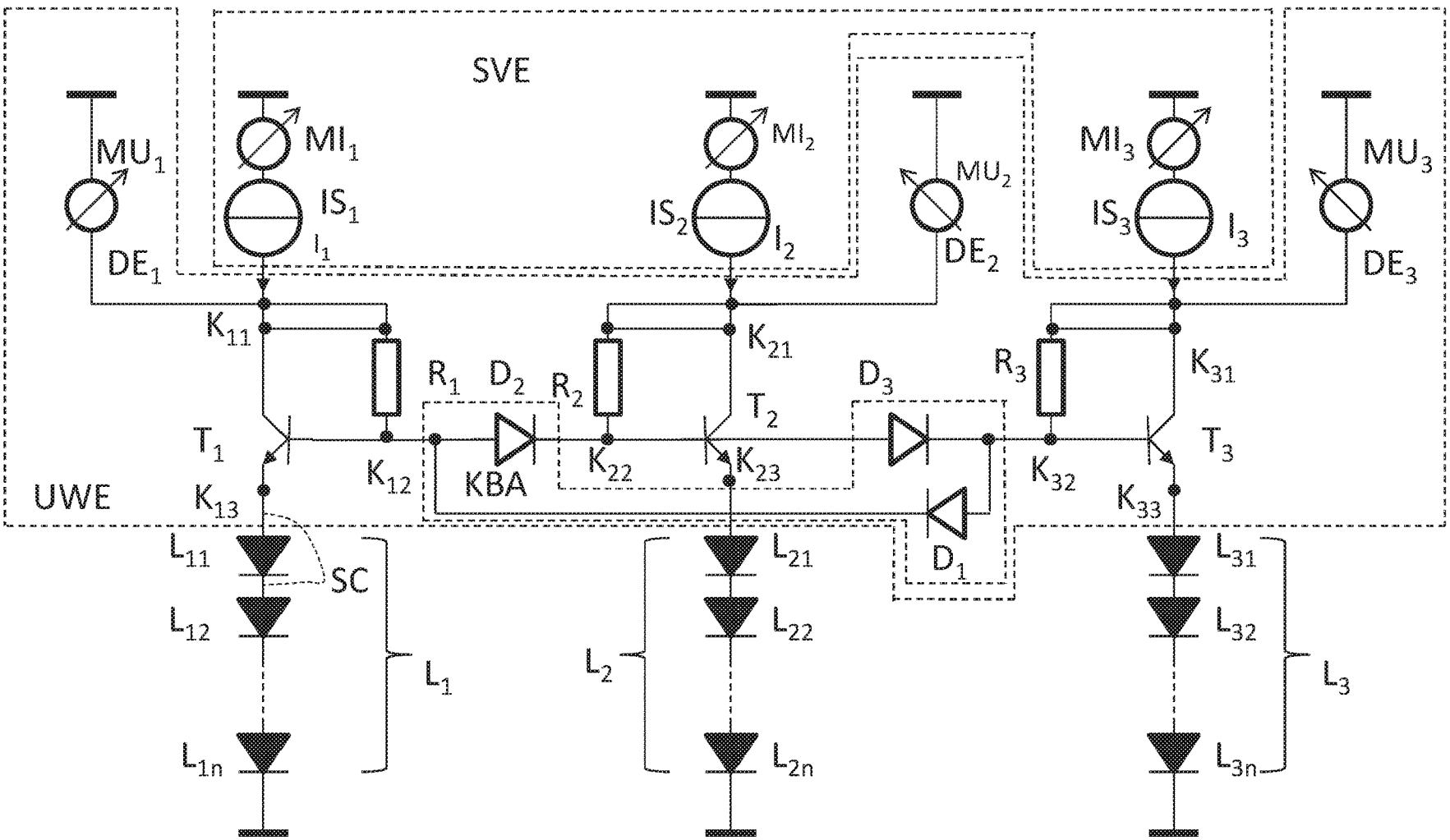
FIG. 8 shows a circuit assembly corresponding to a stringing together of a number of FIG. 2 in a ring.

FIG. 8 corresponds to FIG. 2, in which three LED chains $L_1$, $L_2$, $L_3$ are used in three channels. The coupling component assembly KBA has three diodes $D_1$, $D_2$, $D_3$, which are connected in a triangle, i.e. as a ring circuit, such that a flow of current in a ring—across the first diode $D_1$, then across the second diode $D_2$, then across the third diode $D_3$, and then again across the first diode $D_1$—is possible. The principle can be extended to a positive integer k of channels $CH_1$ to $CH_k$ accordingly. All LED chains of any number k of LED chains are hereby monitored for short circuits of individual LEDs.

Figure 9:
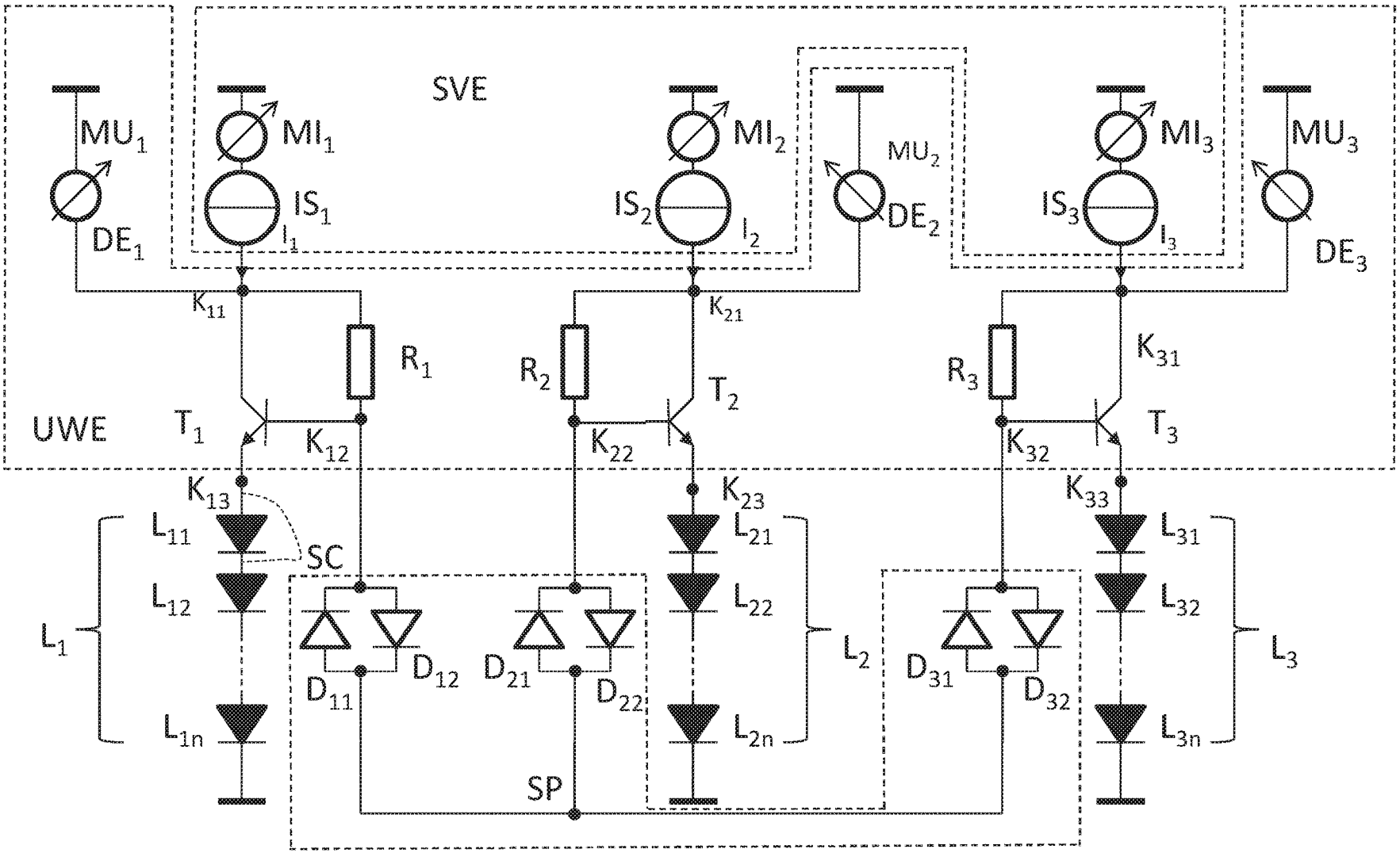
FIG. 9 shows a circuit assembly corresponding to the star-shaped interconnection of a number of FIG. 6.

FIG. 9 shows a coupling component assembly KBA for the connection in a star shape of three channels for three LED chains $L_1$, $L_2$, $L_3$. Each two of the channels correspond here to the circuit according to FIG. 6, with the difference that the first diode $D_1$ and the second diode $D_2$ of FIG. 6 are now formed by four diodes (for example $D_{11}$, $D_{12}$ and $D_{21}$ und $D_{22}$). Since two diode voltages now drop across the first diode $D_1$ and second diode $D_2$ thus replaced, it may be expedient to replace the diodes $D_{11}$, $D_{12}$, $D_{21}$, $D_{22}$, $D_{31}$, $D_{32}$ with diodes having an accordingly reduced switching voltage or corresponding circuits of identical function.

The disclosure may also be described alternatively by one of the following groups of features, wherein the groups of features can be combined arbitrarily with one another and individual features of a group of features also can be combined with one or more features of one or more other groups of features and/or one or more of the previously described examples.

1. A device for supplying at least two LED chains $L_1$,$L_2$, $L_3$ with electricity with the possibility of detecting and then signalling an interruption in the current path within one of these at least two LED chains $L_1$, $L_2$, $L_3$, wherein said device comprises a sub-device StOC which, when one LED or a number of LEDS within a first LED chain is/are short-circuited, brings about a detection and/or subsequent signalling of an interruption of the current path within another LED chain of these at least two LED chains $L_1$, $L_2$, $L_3$, hereinafter the second LED chain.

2. The device according to number 1, wherein a transistor $T_1$, $T_2$, $T_3$, in particular a bipolar transistor or a MOS transistor, with a control connection (base or gate) and two further connections is disposed in each current path of each LED chain of these at least two LED chains $L_1$, $L_2$, $L_3$, wherein each transistor $T_1$, $T_2$, $T_3$ is part of the sub-device, and wherein each transistor $T_1$, $T_2$, $T_3$ is conductive in fault-free operation, and wherein at least one transistor $T_1$, $T_2$ $T_3$ of the second LED chain of the at least two LED chains $L_1$, $L_2$, $L_3$, referred to hereinafter as the second transistor, is switched to be blocking if, in a first LED chain of the at least two LED chains $L_1$, $L_2$, $L_3$, a short circuit (SC) occurs along the LED chain.

3. The device according to either one of the preceding numbers, wherein the at least one transistor of the first LED chain of the at least two LED chains $L_1$, $L_2$, $L_3$, referred to hereinafter as the first transistor, is a bipolar transistor $T_1$, $T_2$, $T_3$ or a MOS transistor $T_1$, $T_2$, $T_3$ and wherein the at least one second transistor of the second LED chain of the at least two LED chains $L_1$, $L_2$, $L_3$ is a bipolar transistor $T_1$, $T_2$, $T_3$ or a MOS transistor $T_1$, $T_2$, $T_3$, and wherein the control connection (base or gate) of the first transistor is connected to the control connection (base or gate) of the second transistor via at least one diode $D_1$, $D_2$, $D_3$, $D_{11}$, $D_{12}$, $D_{21}$, $D_{22}$, $D_{31}$, $D_{32}$ directly or indirectly, in particular via a series resistor $R_{v1}$, $R_{v2}$, and wherein the control connection (base or gate) of the first transistor is energised by means of an operating point setting, in particular such that the control connection (base or gate) of the first transistor is connected via an operating point resistor $R_1$, $R_2$, $R_3$ to the power source $IS_1$, $IS_2$, $IS_3$ of the first LED chain in the current path of which the first transistor is disposed, wherein in the case of a MOS transistor as first transistor the control connection (base or gate) of the first transistor is connected to a connection of the first LED chain via a first auxiliary diode, and wherein in the case of a MOS transistor as second transistor the control connection (base or gate) of the second transistor is connected to a connection of the second LED chain via a second auxiliary diode.

4. The device according to any one of the preceding numbers, wherein the device has at least three LED chains $L_1$, $L_2$, $L_3$ and wherein a transistor $T_1$, $T_2$, $T_3$, in particular a bipolar transistor, is disposed in each current path of each LED chain of these at least three LED chains $L_1$, $L_2$, $L_3$, wherein each transistor $T_1$, $T_2$, $T_3$ is part of the sub-device and wherein each transistor $T_1$, $T_2$, $T_3$ is conductive in fault-free operation, and wherein at least one of these transistors $T_1$, $T_2$, $T_3$, hereinafter referred to as the transistor switched to be blocking, is connected to be blocking if, in at least one other LED chain of the at least three LED chains $L_1$, $L_2$, $L_3$, which is not the LED chain of the transistor switched to be blocking, a short circuit occurs along the other LED chain, and wherein the control connection (base or gate) of each transistor of a preceding LED chain is connected to the control connection (base or gate) of the following transistor of a following LED chain via at least one diode $D_1$, $D_2$, $D_3$, $D_{11}$, $D_{12}$, $D_{21}$, $D_{22}$, $D_{31}$, $D_{32}$ directly or indirectly, in particular via a series resistor $R_{v1}$, $R_{v2}$, $R_{v3}$, and wherein the control connection (base or gate) of the preceding transistor is energised by means of an operating point setting, in particular wherein the control connection (the base or the gate) of the preceding transistor is connected via an operating point resistor $R_1$, $R_2$, $R_3$ to the power source $IS_1$, $IS_2$, $IS_3$ of the associated LED chain in the current path of which the preceding transistor is disposed, and wherein, in the case of a MOS transistor as following transistor, the control connection (base or gate) of the following transistor is connected to a connection of the following LED chain, to which it is connected, via an associated following auxiliary diode, and wherein, in the case of a MOS transistor as preceding transistor, the control connection (base or gate) of the preceding transistor is connected to a connection of the preceding LED chain, to which it is connected, via an associated preceding auxiliary diode, and wherein the diodes are connected in a ring, such that they would enable a flow of current through the diodes in a ring in one direction.

5. The device according to any one of the preceding numbers, wherein the device comprises at least three LED chains $L_1$, $L_2$, $L_3$, and wherein a transistor $T_1$, $T_2$, $T_3$, in particular a bipolar transistor or a MOS transistor, is disposed in each current path of each LED chain of these three LED chains $L_1$, $L_2$, $L_3$, wherein each transistor $T_1$, $T_2$, $T_3$ is part of the sub-device and wherein each transistor $T_1$, $T_2$, $T_3$ is conductive in fault-free operation, and wherein always at least one of these transistors $T_1$, $T_2$, $T_3$ is switched to be blocking if a short circuit occurs in at least one other LED chain of the at least three LED chains $L_1$, $L_2$, $L_3$ which is not the LED chain of the transistor switched to be blocking, and wherein the control connection (base or gate) of each transistor of a preceding LED chain is connected to the control connection (base or gate) of the following transistor via at least two diode pairs $D_{11}$, $D_{12}$; $D_{21}$, $D_{22}$; $D_{31}$, $D_{32}$ connected one after the other in series and formed in each case of two diodes $D_{11}$, $D_{12}$; $D_{21}$, $D_{22}$; $D_{31}$, $D_{32}$ connected anti-parallel, wherein the diodes have two connections and wherein each diode can be connected in series with a resistor, and wherein the control connection (base or gate) of the preceding transistor is energised by means of an operating point setting, in particular wherein the control connection (base or gate) of the preceding transistor is connected via an operating point resistor $R_1$, $R_2$, $R_3$ to the power source $IS_1$, $IS_2$, $IS_3$ of the associated LED chain in the current path of which the preceding transistor is disposed, and wherein in the case of a MOS transistor as following transistor the control connection (base or gate) of the following transistor is connected to a connection of the following LED chain, to which it is connected, via an associated following auxiliary diode, and wherein in the case of a MOS transistor as preceding transistor, the control connection (bass or gate) of the preceding transistor is connected to a connection of the preceding LED chain, to which it is connected, via an associated preceding auxiliary diode, and wherein the diodes are connected such that they are connected by means of a connection to a common star point SP.

6. A device for supplying at least two LED chains $L_1$, $L_{12}$, . . . $L_{1n}$; $L_{21}$, $L_{22}$, . . . $L_{2n}$; $L_{31}$, $L_{32}$, . . . $L_{3n}$ with electricity, with the possibility of detecting and then signalling an interruption of the current path within one of these at least two LED chains $L_{11}$, $L_{12}$, . . . $L_{1n}$; $L_{21}$, $L_{22}$, . . . $L_{2n}$; $L_{31}$, $L_{32}$, . . . $L_{3n}$, wherein the device comprises a sub-device StOC which, when one LED or a number of LEDS within a first LED chain of the at least LED chains $L_{11}$, $L_{12}$, . . . $L_{1n}$; $L_{21}$, $L_{22}$, . . . , $L_{2n}$; $L_{31}$, $L_{32}$, . . . $L_{3n}$ is/are short-circuited, performs a detection, and wherein the sub-device StOC brings about a signalling of this detected short circuit by means of an interruption of the current path within another LED chain of these at least two LED chains $L_{11}$, $L_{12}$, . . . $L_{1n}$; $L_{21}$, $L_{22}$ . . . $L_{2n}$; $L_{31}$, $L_{32}$, . . . $L_{3n}$, hereinafter the second LED chain.

7. The device according to any one of the preceding numbers, wherein a transistor $T_1$, $T_2$, $T_3$, in particular a bipolar transistor or a MOS transistor, with a control connection (base) and two further connections is disposed in each current path of each LED chain of these at least two LED chains $L_{11}$, $L_{12}$, . . . $L_{1n}$; $L_{21}$, $L_{22}$, . . . $L_{2n}$; $L_{31}$, $L_{32}$, . . . $L_{3n}$, wherein each transistor $T_1$, $T_2$, $T_3$ is part of the sub-device, and wherein each transistor $T_1$, $T_2$, $T_3$ is conductive in fault-free operation, and wherein at least one transistor $T_1$, $T_2$, $T_3$ of the second LED chain of the at least two LED chains $L_{11}$, $L_{12}$, . . . $L_{1n}$; $L_{21}$, $L_{22}$, . . . $L_{2n}$; $L_{31}$, $L_{32}$, . . . $L_{3n}$, referred to hereinafter as the second transistor, is switched to be blocking if, in a first LED chain of the at least two LED chains $L_{11}$, $L_{12}$, . . . $L_{1n}$; $L_{21}$, $L_{22}$, . . . $L_{2n}$; $L_{31}$, $L_{32}$, . . . $L_{3n}$, a short circuit (SC) occurs along the LED chain.

8. The device according to any one of the preceding numbers, wherein the at least one transistor of the first LED chain of the at least two LED chains $L_{11}$, $L_{12}$, . . . $L_{1n}$; $L_{21}$, $L_{22}$, . . . $L_{2n}$; $L_{31}$, $L_{32}$, . . . $L_{3n}$, referred to hereinafter as the first transistor, is a bipolar transistor $T_1$, $T_2$, $T_3$ or a MOS transistor $T_1$, $T_2$, $T_3$, and wherein the at least one second transistor of the second LED chain of the at least two LED chains $L_{11}$, $L_{12}$, . . . $L_{1n}$; $L_{21}$, $L_{22}$, . . . $L_{2n}$; $L_{31}$, $L_{32}$, . . . $L_{3n}$ is a bipolar transistor $T_1$, $T_2$, $T_3$ or a MOS transistor $T_1$, $T_2$, $T_3$, and wherein the control connection (base) of the first transistor is connected to the control connection (base or gate) of the second transistor via at least one diode $D_1$, $D_2$, $D_3$, $D_{11}$, $D_{12}$, $D_{21}$, $D_{22}$, $D_{31}$, $D_{32}$ directly or indirectly, in particular via a series resistor $R_{v1}$, $R_{v2}$, and wherein the control connection (base) of the first transistor is energised by means of an operating point setting, in particular such that the control connection (base or gate) of the first transistor is connected via an operating point resistor $R_1$, $R_2$, $R_3$ to the power source $IS_1$, $IS_2$, $IS_3$ of the first LED chain in the current path of which the first transistor is disposed.

9. The device according to any one of the preceding numbers, wherein the device has at least three LED chains $L_1$, $L_{12}$, . . . $L_{1n}$; $L_{21}$, $L_{22}$, . . . $L_{2n}$; $L_{31}$, $L_{32}$, . . . $L_{3n}$, and wherein a transistor $T_1$, $T_2$, $T_3$, in particular a bipolar transistor, is disposed in each current path of each LED chain of these at least three LED chains $L_1$, $L_{12}$, . . . $L_{1n}$; $L_{21}$, $L_{22}$, . . . $L_{2n}$; $L_{31}$, $L_{32}$, . . . $L_{3n}$, wherein each transistor $T_1$, $T_2$, $T_3$ is part of the sub-device and wherein each transistor $T_1$, $T_2$, $T_3$ is conductive in fault-free operation, and wherein at least one of these transistors $T_1$, $T_2$, $T_3$, hereinafter referred to as the transistor switched to be blocking, is switched to be blocking if, in at least one other LED chain of the at least three LED chains $L_{11}$, $L_{12}$, . . . $L_{1n}$; $L_{21}$, $L_{22}$, . . . $L_{2n}$; $L_{31}$, $L_{32}$, . . . $L_{3n}$ which is not the LED chain of the transistor switched to be blocking, a short circuit occurs along the LED chain in question, and wherein the control connection (base) of each transistor of a preceding LED chain is connected to the control connection (base) of the following transistor of a following LED chain via at least one diode $D_1$, $D_2$, $D_3$, $D_{11}$, $D_{12}$, $D_{21}$, $D_{22}$, $D_{31}$, $D_{32}$ directly or indirectly, in particular via a resistor $R_{v1}$, $R_{v2}$, $R_{v3}$, and wherein the control connection (base) of the preceding transistor is energised by means of an operating point setting, in particular wherein the control connection (the base or the gate) of the preceding transistor is connected via an operating point resistor $R_1$, $R_2$, $R_3$ to the power source $IS_1$, $IS_2$, $IS_3$ of the associated LED chain in the current path of which the preceding transistor is disposed, and wherein the diodes are connected in a ring, such that they would enable a flow of current through the diodes in a ring in one direction.

10. The device according to any one of the preceding numbers, wherein the device has at least three LED chains $L_{11}$, $L_{12}$, . . . $L_{1n}$; $L_{21}$, $L_{22}$, . . . $L_{2n}$; $L_{31}$, $L_{32}$, . . . $L_{3n}$ and wherein a transistor $T_1$, $T_2$, $T_3$, in particular a bipolar transistor or a MOS transistor, is disposed in each current path of each LED chain of these three LED chains $L_1$, $L_{12}$, . . . $L_{1n}$; $L_{21}$, $L_{22}$, . . . $L_{2n}$; $L_{31}$, $L_{32}$, . . . $L_{3n}$, wherein each transistor $T_1$, $T_2$, $T_3$ is part of the sub-device, and wherein each transistor $T_1$, $T_2$, $T_3$ is conductive in fault-free operation, and wherein at least one of these transistors $T_1$, $T_2$, $T_3$ is always switched to be blocking if, in at least one other LED chain of the at least three LED chains $L_1$, $L_{12}$, . . . $L_{1n}$; $L_{21}$, $L_{22}$, . . . $L_{2n}$; $L_{31}$, $L_{32}$, . . . $L_{3n}$ which is not the LED chain of the transistor switched to be blocking, a short circuit occurs, and wherein the control connection (base) of each transistor of a preceding LED chain is connected to the control connection (base) of the following transistor via at least two diode pairs $D_{11}$, $D_{12}$; $D_{21}$, $D_{22}$; $D_{31}$, $D_{32}$ connected one after the other in series and formed in each case of two diodes $D_{11}$, $D_{12}$; $D_{21}$, $D_{22}$; $D_{31}$, $D_{32}$ connected anti-parallel, wherein the diodes have two connections, and wherein each diode can be connected in series with a resistor, and wherein the control connection (base) of the preceding transistor is energised by means of an operating point setting, in particular wherein the control connection (base) of the preceding transistor is connected via an operating point resistor $R_1$, $R_2$, $R_3$ to the power source $IS_1$, $IS_2$, $IS_3$ of the associated LED chain in the current path of which the preceding transistor is disposed, and wherein the diodes are connected such that they are connected by means of a connection to a common star point SP.

11. The device according to any one of the preceding numbers, wherein the device comprises measurement means $MI_1$, $MU_1$; $MI_2$, $MU_2$; $MI_3$, $MU_3$ for detecting the interruption of the second LED chain, and wherein the device comprises suitable signalling means so as to be able to signal the detection result of the measurement means $MI_1$, $MU_1$; $MI_2$, $MU_2$; $MI_3$, $MU_3$ to a control device.

12. A method for detecting an individual LED failure in a lighting device comprising at least two LED chains $L_1$, $L_2$, $L_3$, said method comprising the following steps:

detecting an individual LED short circuit in a first LED chain of the at least two LED chains $L_1$, $L_2$, $L_3$ by a first detection means (for example first transistor $T_1$ and first diode $D_1$ in cooperation with first resistor $R_1$ in FIG. 3) and interrupting, as a result of this detection, the flow of current through at least one other LED chain of the at least two LED chains $L_1$, $L_2$, $L_3$ by an interruption means (for example transistor $T_2$ in FIG. 3), detecting the interruption of the flow of current through the other LED chain of the at least two LED chains $L_1$, $L_2$, $L_3$.

GLOSSARY

LED

An LED in the sense of this disclosure is not only an individual light-emitting diode, but may also be a series and/or parallel circuit of multiple light-emitting diodes, which optionally also comprises further components, such as Zener diodes and/or series resistors and parallel resistors and capacitors. The circuits are typically bipolar circuits with a first connection, which serves as current input, and a second connection, which serves as current output. If the LEDs in an LED chain are connected to one another in series, it is thus conceivable that, between the LEDs, further lines are guided fully or partially along the LED chain, for example as control line for other purposes not claimed here, but are not intended to limit the claimed scope merely to individual bipolar light-emitting diodes. The LED chains are preferably of equal length, that is to say preferably contain the same number of LEDs with preferably identical diode switching voltages ($U_D$).

LED Chain

An LED chain in the sense of this disclose is a series circuit formed of at least two LEDs, which are all oriented identically, such that a flow of current is possible.

Switching Voltage

In the sense of this disclosure the switching voltage of a diode, auxiliary diode or LED is the voltage at which the diode, auxiliary diode or LED starts to become conductive. With regard to the coupling component assembly, the switching voltage determines the greatest voltage drop across the coupling component assembly at which this is connected through.

LIST OF REFERENCE SIGNS $CH_1$ first channel. The first channel comprises the first power source—here the first current source $IS_1$—the first LED chain $L_1$, the first transistor $T_1$, the first resistor $R_1$, the first diode $D_1$, and first measurement means $MI_1$,$MU_1$. The first transistor $T_1$ is connected in series with the first LED chain $L_1$ at the third node $K_{13}$ of the first channel, and at the first node Ku of the first channel is connected to the first power source, here the first current source $IS_1$, and optionally to a first voltage measurement means $MU_1$ and the first resistor $R_1$. The first resistor $R_1$ is connected to the third node $K_{13}$ of the first channel, which establishes the connection to the control connection of the first transistor $T_1$ and to a first connection of the first diode $D_1$. This first diode is then connected by means of its second connection to the corresponding control connection of the transistor of a following channel. In this regard it is particularly advantageous in various examples if the third node $K_{13}$ of the first channel also establishes a connection to the second connection of the diode of the following channel or a preceding channel. In addition, the first channel may comprise a first current measurement means $MI_1$, which detects the value of the first electrical current $I_1$ output by the power source. The first channel typically comprises at least one of these first measurement means, i.e. at least the first current measurement means $MI_1$ or the first voltage measurement means $MU_1$, so as to be able to detect an interruption of the first LED chain $L_1$.

$CH_2$ second channel. The second channel comprises the second power source—here the second current source $IS_2$—the second LED chain $L_2$, the second transistor $T_2$, the second resistor $R_2$, the second diode $D_2$, and second measurement means $MI_2$, $MU_2$. The second transistor $T_2$ is connected in series with the second LED chain $L_2$ at the third node $K_{23}$ of the second channel, and at the second node $K_{21}$ of the second channel is connected to the second power source, here the second current source $IS_2$, and optionally to a second voltage measurement means $MU_2$ and the second resistor $R_2$. The second resistor $R_2$ is connected to the second node $K_{23}$ of the second channel, which establishes the connection to the control connection of the second transistor $T_2$ and to a second connection of the second diode $D_2$. This second diode is then connected by means of its second connection to the corresponding control connection of the transistor of a following channel. In this regard it is particularly advantageous in various examples if the second node $K_{23}$ of the second channel also establishes a connection to the second connection of the diode of the following channel or a preceding channel. In addition, the second channel may comprise a second current measurement means $MI_2$, which detects the value of the second electrical current $I_2$ output by the power source. The second channel typically comprises at least one of these second measurement means, i.e. at least the second current measurement means ($MI_2$) or the second voltage measurement means $MU_2$, so as to be able to detect an interruption of the second LED chain $L_2$.

$CH_3$ third channel. The third channel comprises the third power source—here the third current source $IS_3$— the third LED chain $L_3$, the third transistor $T_3$, the third resistor $R_3$, the third diode $D_3$, and third measurement means $MI_3$, $MU_3$. The third transistor $T_3$ is connected in series with the third LED chain $L_3$ at the third node $K_{33}$ of the third channel, and at the first node $K_{31}$ of the third channel is connected to the third power source, here the third current source $IS_3$, and optionally to a third voltage measurement means $MU_3$ and the third resistor $R_3$. The third resistor $R_3$ is connected to the third node $K_{33}$ of the third channel, which establishes the connection to the control connection of the third transistor $T_3$ and to a first connection of the third diode $D_3$. This third diode is then connected by means of its second connection to the corresponding control connection of the transistor of a following channel. In this regard it is particularly advantageous in various examples if the third node $K_{33}$ of the third channel also establishes a connection to the second connection of the diode of the following channel or a preceding channel. In addition, the third channel may comprise a third current measurement means $MI_3$, which detects the value of the third electrical current $I_3$ output by the power source. The third channel typically comprises at least one of these third measurement means, i.e. at least the third current measurement means $MI_3$ or the third voltage measurement means $MU_3$, so as to be able to detect an interruption of the third LED chain $L_3$.

$D_1$ first diode of the first channel $CH_1$ $D_2$ second diode of the second channel $CH_2$ $D_3$ third diode of the third channel $CH_3$ $D_{11}$ first forward diode of the first channel $CH_1$ $D_{12}$ first reverse diode of the first channel $CH_1$ $D_{21}$ first forward diode of the second channel $CH_2$ $D_{22}$ first reverse diode of the second channel $CH_2$ $D_{31}$ first forward diode of the third channel $CH_3$ $D_{32}$ first reverse diode of the third channel $CH_3$ $DE_1$ first detector $DE_2$ second detector $DE_3$ third detector DU diode switching voltage (This is the diode voltage at which the flow of current starts)

$HD_1$ first auxiliary diode of the first channel $CH_1$. The first auxiliary diode is necessary as detection device if, instead of a bipolar transistor, a MOS transistor is used as first transistor $T_1$. The first auxiliary diode then emulates the function of the base-emitter diode as detection device and forces the potential of a transistor of another channel to a potential at which the gate-source section no longer has sufficient voltage, whereby this starts to block if there is a short circuit of an individual LED or a plurality of LEDs along the LED chain in question. With the use of MOS transistors the functions of a detection device (first auxiliary device) and interruption device first transistor $T_1$) are thus separated, whereas in bipolar transistors they can be carried out simultaneously by the bipolar transistors (first transistor $T_1$ alone). With use of a bipolar transistor as first transistor $T_1$ the first auxiliary diode $HD_1$ therefore is not absolutely necessary.

$HD_2$ second auxiliary diode of the second channel $CH_2$. The second auxiliary diode is necessary as detection device if, instead of a bipolar transistor, a MOS transistor is used as second transistor $T_2$. The second auxiliary diode then emulates the function of the base-emitter diode as detection device and forces the potential of a transistor of another channel to a potential at which the gate-source section no longer has sufficient voltage, whereby this starts to block if there is a short circuit of an individual LED or a plurality of LEDs along the LED chain in question. With the use of MOS transistors the functions of a detection device (second auxiliary device) and interruption device second transistor $T_2$) are thus separated, whereas in bipolar transistors they can be carried out simultaneously by the bipolar transistors (second transistor $T_2$ alone). With use of a bipolar transistor as second transistor $T_2$ the second auxiliary diode $HD_1$ therefore is not absolutely necessary.

$HD_3$ third auxiliary diode of the third channel $CH_3$. The third auxiliary diode is necessary as detection device if, instead of a bipolar transistor, a MOS transistor is used as third transistor $T_3$. The third auxiliary diode then emulates the function of the base-emitter diode as detection device and forces the potential of a transistor of another channel to a potential at which the gate-source section no longer has sufficient voltage, whereby this starts to block if there is a short circuit of an individual LED or a plurality of LEDs along the LED chain in question. With the use of MOS transistors the functions of a detection device (third auxiliary device) and interruption device (third transistor $T_3$) are thus separated, whereas in bipolar transistors they can be carried out simultaneously by the bipolar transistors (third transistor $T_3$ alone). With use of a bipolar transistor as third transistor $T_3$ the third auxiliary diode therefore is not absolutely necessary.

$I_1$ first electrical current, which is fed into the first LED chain $L_1$ from the first power source—here the first current source $IS_1$—and supplies this with electricity.

$I_2$ second electrical current, which is fed into the second LED chain $L_2$ from the second power source—here the second current source $IS_2$—and supplies this with electricity.

$I_3$ third electrical current, which is fed into the third LED chain $L_3$ from the third power source—here the third current source $IS_3$— and supplies this with electricity.

$IS_1$ first current source as first power source of the first channel $CH_1$ $IS_2$ second current source as second power source of the second channel $CH_2$ $IS_3$ third current source as third power source of the third channel $CH_3$ Ku first node of the first channel $CH_1$. The first node of the first channel $CH_1$ connects the first power source, here the first current source $IS_1$, to the first transistor $T_1$ and the first resistor $R_1$, and a first voltage measurement means $MU_1$ for detecting the voltage drop across the first power source, here the first current source $IS_1$.

$K_{12}$ second node of the first channel $CH_1$. The second node of the first channel $CH_1$ connects the control connection of the first transistor $T_1$ to the first resistor $R_1$ and the first diode $D_1$. In the case of an NPN bipolar transistor as first transistor $T_1$ the connection of the first diode $D_1$ is the cathode thereof (FIG. 2). In the case of a PNP bipolar transistor as first transistor $T_1$ it is the anode (FIG. 3). If the first transistor $T_1$ is a MOS transistor, the second node of the first channel $CH_1$ may also be connected to a first auxiliary diode $HD_1$, which is connected to a third node $K_{13}$ of the first channel $CH_1$ and the orientation of which likewise conforms with the transistor type of the first transistor $T_1$.

$K_{13}$ third node of the first channel $CH_1$. The third node of the first channel $CH_1$ connects the first transistor $T_1$ to a first connection of the first LED chain $L_1$. It likewise optionally connects this to the second connection of a first auxiliary diode $HD_1$. This is helpful in particular if the first transistor $T_1$ is a MOS transistor. The orientation of the first auxiliary diode $HD_1$ then again conforms with the transistor type (P-channel MOS transistor or N-channel MOS transistor) of the first transistor $T_1$.

$K_{21}$ first node of the second channel $CH_2$. The first node of the second channel $CH_2$ connects the second power source, here the second current source $IS_2$, to the second transistor $T_2$ and the second resistor $R_2$, and a second voltage measurement means $MU_2$ for detecting the voltage drop across the second power source, here the second current source $IS_2$.

$K_{22}$ second node of the second channel $CH_2$. The second node of the second channel $CH_2$ connects the control connection of the second transistor $T_2$ to the second resistor $R_2$ and the second diode $D_2$. In the case of an NPN bipolar transistor as second transistor $T_2$ the connection of the second diode $D_2$ is the cathode thereof. In the case of a PNP bipolar transistor as second transistor $T_2$ it is the anode (FIG. 3). If the second transistor $T_2$ is a MOS transistor the second node of the second channel $CH_2$ may also be connected to a second auxiliary diode $HD_2$, which is connected to the third node $K_{23}$ of the second channel $CH_2$ and the orientation of which likewise conforms with the transistor type of the second transistor $T_2$.

$K_{23}$ third node of the second channel $CH_2$. The third node of the second channel $CH_2$ connects the second transistor $T_2$ to a first connection of the second LED chain $L_2$. It likewise optionally connects this to the second connection of a second auxiliary diode $HD_2$. This is helpful in particular if the second transistor $T_2$ is a MOS transistor. The orientation of the second auxiliary diode $HD_2$ then again conforms with the transistor type (P-channel MOS transistor or N-channel MOS transistor) of the second transistor $T_2$.

$K_{31}$ first node of the third channel $CH_3$. The first node of the third channel $CH_3$ connects the third power source, here the third current source $IS_3$, to the third transistor $T_3$ and the third resistor $R_3$, and a third voltage measurement means $MU_3$ for detecting the voltage drop across the third power source, here the third current source $IS_3$.

$K_{32}$ second node of the third channel $CH_3$. The second node of the third channel $CH_3$ connects the control connection of the third transistor $T_3$ to the third resistor $R_3$ and the third diode $D_3$. In the case of an NPN bipolar transistor as third transistor $T_3$ the connection of the third diode $D_3$ is the cathode thereof (FIG. 2). In the case of a PNP bipolar transistor as third transistor $T_3$ it is the anode (FIG. 3). If the third transistor $T_3$ is a MOS transistor the second node of the third channel $CH_3$ may also be connected to a third auxiliary diode $HD_3$, which is connected to the third node $K_{33}$ of the third channel $CH_3$ and the orientation of which likewise conforms with the transistor type.

$K_{33}$ third node of the third channel $CH_3$. The third node of the third channel $CH_3$ connects the third transistor $T_3$ to a first connection of the third LED chain $L_3$. It likewise optionally connects this to the second connection of a third auxiliary diode $HD_3$. This is helpful in particular if the third transistor $T_3$ is a MOS transistor. The orientation of the third auxiliary diode $HD_3$ then again conforms with the transistor type (P-channel MOS transistor or N-channel MOS transistor) of the third transistor $T_3$.

KBA coupling component assembly $L_1$ first LED chain $L_2$ second LED chain $L_3$ third LED chain $L_{11}$ first LED in the first LED chain $L_{12}$ second LED in the first LED chain $L_{1n}$ $n^{th}$ LED in the first LED chain $L_{21}$ first LED in the second LED chain $L_{32}$ second LED in the second LED chain $L_{4n}$ $n^{th}$ LED in the second LED chain $L_{31}$ first LED in the third LED chain $L_{32}$ second LED in the third LED chain $L_{3n}$ $n^{th}$ LED in the third LED chain $MI_1$ first current measurement means. This measurement means is used to detect an interruption in the first LED chain $L_1$.

$MI_2$ second current measurement means. This measurement means is used to detect an interruption in the second LED chain $L_2$.

$MI_3$ third current measurement means. This measurement means is used to detect an interruption in the third LED chain $L_3$.

$MU_1$ first voltage measurement means. This measurement means is used to detect an interruption in the first LED chain L.

$MU_2$ second voltage measurement means. This measurement means is used to detect an interruption in the second LED chain ($L_{21}$, $L_{22}$, . . . . $L_{2n}$).

$MU_3$ third voltage measurement means. This measurement means is used to detect an interruption in the third LED chain ($L_{31}$, $L_{32}$, . . . . $L_{3n}$).

$R_1$ first resistor $R_2$ second resistor $R_3$ third resistor $R_{v1}$ first series resistor. The first series resistor can be connected in series for example to the first diode $D_1$ so as to make the switching thresholds between different channels asymmetrical. It is then necessary that the first series resistor deviates from another series resistor, for example from the second series resistor $R_{v2}$ in FIG. 6.

$R_{v2}$ second series resistor. The second series resistor can be connected in series for example to the second diode $D_2$ so as to be able to make the switching thresholds between different channels asymmetrical. It is then necessary that the second series resistor deviates from another series resistor, for example from the first series resistor $R_{v1}$ in FIG. 6.

$R_{v3}$ third series resistor. The third series resistor can be connected in series for example to the third diode $D_3$ so as to be able to make the switching thresholds between different channels asymmetrical. It is then necessary that the first series resistor deviates from another series resistor, for example from the second series resistor $R_{v2}$ and/or from the first series resistor $R_{v1}$.

SC hypothetical, exemplary short circuit

StOC short-to-open converter. This is a sub-device which, in the event of a short circuit of one LED or multiple LEDs within a considered LED chain, brings about a detection and/or subsequent signalling of an interruption of the current path within another LED chain of the at least two LED chains $L_1$, $L_2$, $L_3$.

SVE (multi-channel) current supply unit $T_1$ first transistor $T_2$ second transistor $T_3$ third transistor UWE monitoring unit $V_{bat}$ operating voltage connection

The invention claimed is:

1. A lighting device, particularly for vehicles, comprising at least two LED chains, each LED chain including a respective series circuit including a plurality of LEDs, a multi-channel power supply unit for the at least two LED chains including at least two power sources, wherein each LED chain is associated with a respective power source and each LED chain is electrically connected on one side to a power supply output connection of the respective power source included in the multi-channel power supply unit and on the other side to a reference potential, and a monitoring device for detecting a short circuit in a predefinable number of LEDs of any one of the at least two LED chains, wherein the monitoring device is provided with:

a detector for each LED chain for identifying and signalling an interruption in the current flow in the respective LED chain, a controllable interrupter switch for each LED chain, the respective controllable interrupter switch for each LED chain including a respective control connection controllable by a respective control signal and a respective current path which can be switched to a conductive state or a non-conductive state depending on a magnitude of the respective control signal, wherein the respective controllable interrupter switch for each LED chain is connected in series with the respective LED chain, and at least one coupling component assembly connected respectively between each of the control connections of the respective controllable interrupter switches for enabling a flow of current from the respective control connection of one controllable interrupter switch to the respective control connection of the other controllable interrupter switch when a voltage of a value greater than or equal to a predefinable switching voltage is applied across the respective at least one coupling component assembly, wherein, in the event of a short circuit of the predefined number of LEDs in the LED chain associated with the one controllable interrupter switch, the voltage of the value greater than or equal to the predefinable switching voltage is applied across the respective coupling component assembly, and therefore the control signal of the other controllable interrupter switch associated with another LED chain assumes a value that opens the other controllable interrupter switch, such that the detector associated with the other LED chain signals an interruption of the current flow in the other LED chain.

2. The lighting device according to claim 1, wherein the each coupling component assembly enables a flow of current in one direction or in another opposite direction only with a predefinable polarity of the voltage applied across the respective coupling component assembly or depending on the polarity of the voltage applied across the respective coupling component assembly.

3. The lighting device according to claim 1, wherein each of the coupling component assemblies has two or more diodes connected in an anti-parallel arrangement to enable a flow of current in both directions.

4. The lighting device according to claim 1, wherein the monitoring device, wherein the at least two LED chains includes more than two LED chains, has a number of coupling component assemblies equaling a number of LED chains, wherein the control connections of the respective controllable interrupter switches associated with each of the LED chains are coupled cyclically by the respective coupling component assemblies and therefore as a ring circuit.

5. The lighting device according to claim 4, wherein each of the coupling component assemblies enables a respective flow of current in a same direction through the ring circuit.

6. The lighting device according to claim 1, wherein the monitoring device, wherein the at least two LED chains includes more than two LED chains, has a number of coupling component assemblies equaling a number of LED chains, wherein the control connections of the respective controllable interrupter switches associated with each of the LED chains are coupled in a star circuit by the respective coupling component assemblies.

7. The lighting device according to claim 6, wherein each coupling component assembly enables unidirectional flows of current.

8. The lighting device according to claim 1, wherein the controllable interrupter switches are formed as bipolar, FET or MOS transistors.

9. The lighting device according to claim 1, wherein for each LED chain the respective controllable interrupter switch is connected such that the respective current is between the power supply output connection of the power supply unit and the respective LED chain.

10. The lighting device according to claim 1, wherein a number of LEDs for which the short circuit can be detected by the monitoring device in the anyone of the least two LED chains is equal to greater than one.

* * * * *